US010829877B2

(12) United States Patent
Takayama et al.

(10) Patent No.: US 10,829,877 B2
(45) Date of Patent: Nov. 10, 2020

(54) WARP KNITTING MACHINE, WARP KNITTED FABRIC MANUFACTURING METHOD AND WARP KNITTED FABRIC

(71) Applicant: NIPPON MAYER LTD., Fukui-shi, Fukui (JP)

(72) Inventors: Hirokazu Takayama, Fukui (JP); Minoru Ota, Fukui (JP); Kazuhiro Osawa, Fukui (JP); Sachiko Koide, Fukui (JP); Isao Takaoka, Fukui (JP)

(73) Assignee: NIPPON MAYER LTD., Fukui (JP)

( * ) Notice: Subject to any disclaimer, the term of this patent is extended or adjusted under 35 U.S.C. 154(b) by 109 days.

(21) Appl. No.: 16/113,232

(22) Filed: Aug. 27, 2018

(65) Prior Publication Data

US 2020/0063301 A1 Feb. 27, 2020

(51) Int. Cl.
*D04B 21/06* (2006.01)
*D04B 21/20* (2006.01)

(52) U.S. Cl.
CPC ..... *D04B 21/06* (2013.01); *D04B 21/207* (2013.01)

(58) Field of Classification Search
CPC ..... D04B 21/06; D04B 21/10; D04B 21/20; D04B 21/202; D04B 23/20; D04B 23/22; D04B 21/207
See application file for complete search history.

(56) References Cited

U.S. PATENT DOCUMENTS 4,785,558 A * 11/1988 Shiomura ..... A43B 1/04 36/114
4,787,219 A * 11/1988 Sato ..... B29C 70/24 66/190
4,835,989 A * 6/1989 Hall ..... D04B 21/12 66/192
5,385,036 A * 1/1995 Spillane ..... A43B 1/04 2/16
5,544,500 A * 8/1996 Speich ..... D04B 27/26 66/207
6,477,865 B1 * 11/2002 Matsumoto ..... D04B 21/10 66/195
6,854,296 B1 * 2/2005 Miller, III ..... D04B 1/123 66/190
7,076,974 B1 * 7/2006 Chen ..... D04B 21/10 66/195
7,213,421 B2 * 5/2007 Shirasaki ..... D04B 21/14 66/193
7,290,411 B1 * 11/2007 Lonati ..... D04B 27/08 66/204
8,904,829 B2 * 12/2014 Keitch ..... D04B 21/16 66/195

(Continued)

FOREIGN PATENT DOCUMENTS

JP 2001-123361 5/2001
JP 2004-019040 1/2004

(Continued)

*Primary Examiner* — Danny Worrell
(74) *Attorney, Agent, or Firm* — Norris McLaughlin, P.A.

(57) ABSTRACT

Provided is a warp knitting machine capable of irregularities conforming to a pattern in a warp knitted fabric.
The warp knitting machine according to an embodiment is a double raschel machine, and includes at least one guide bar GB5 between a pair of jacquard bars at a front side (JB3, JB4), and a pair of jacquard bars at a back side (JB6, JB7).

6 Claims, 14 Drawing Sheets

(56) References Cited

U.S. PATENT DOCUMENTS

| | | | | |
|---|---|---|---|---|
| 9,677,209 | B2 * | 6/2017 | Daube | D04B 21/14 |
| 2003/0106346 | A1 * | 6/2003 | Matsumoto | D04B 21/10 66/195 |
| 2005/0193592 | A1 * | 9/2005 | Dua | A43B 1/04 36/45 |
| 2011/0247370 | A1 * | 10/2011 | Akao | D04B 21/16 66/195 |
| 2017/0107649 | A1 * | 4/2017 | Lonati | D04B 27/12 |

FOREIGN PATENT DOCUMENTS

| | | |
|---|---|---|
| JP | 2005-042266 | 2/2005 |
| JP | 2006-161167 | 6/2006 |
| JP | 2008-169533 | 7/2008 |

* cited by examiner

B F B F B F
GB2

B F B F B F
JB3,4

B F B F B F
GB5

B F B F B F
JB6,7

B F B F B F
GB8

B F B F B F
GB9

B F B F B F B F
GB2

B F B F B F B F
JB3,4

B F B F B F B F
GB5

B F B F B F B F
JB6,7

B F B F B F B F
GB8

B F B F B F B F
GB9

B F B F B F
GB2

B F B F B F
JB3,4

B F B F B F
GB5

B F B F B F
JB6,7

B F B F B F
GB8

B F B F B F
GB9

WARP KNITTING MACHINE, WARP KNITTED FABRIC MANUFACTURING METHOD AND WARP KNITTED FABRIC

TECHNICAL FIELD

The present invention relates to a warp knitting machine, a method of manufacturing a warp knitted fabric and the warp knitted fabric.

BACKGROUND ART

As a warp knitting machine that knits a warp knitted fabric, there has been known a double raschel machine provided with two front and back rows of knitting needles, in which a front-side base fabric and a back-side base fabric are knitted by the front-side row of knitting needles and the back-side row of knitting needles, respectively, and the front-side base fabric and the back-side base fabric are joined on at least a part of the warp knitted fabric.

As described in Japanese Patent Laid-Open Publication No. 2008-169533, there is known a double raschel machine including two jacquard bars. The conventionally known double raschel machine including two jacquard bars includes a pair of jacquard bars at the front side, a pair of jacquard bars at the back side, at least one guide bar in front of the pair of front-side jacquard bars, and at least one guide bar in back of the pair of back-side jacquard bars. By using such a double raschel machine including the front-side and back-side jacquard bars, a warp knitted fabric having a jacquard pattern formed on a front-side base fabric and a back-side base fabric may be manufactured.

DISCLOSURE OF THE INVENTION

Problem that the Invention is to Solve

Meanwhile, it has been recently required to form not only a pattern on a warp knitted fabric manufactured by a double raschel machine, but also irregularities conforming to the pattern. For example, recently, as a method of manufacturing a shoe upper, a manufacturing method using warp-knitting with a high manufacturing efficiency attracts attention. Then, it is required to form not only a pattern on a shoe upper, but also irregularities conforming to the pattern.

However, in a warp knitted fabric manufactured by the conventionally known double raschel machine, a surface becomes almost flat. For example, it is possible to form slight irregularities, which may be recognized by touch, according to a pattern by supplying yarns thicker than other yarns to a jacquard bar, but it is impossible to form irregularities with a sufficient size enough to be recognized at a glance, according to a pattern.

A quilting has conventionally been known as a cloth having irregularities. However, in the manufacturing method of the quilting, first, a front cloth and a back cloth are individually manufactured, and a core material is interposed between the front cloth and the back cloth, and finally sewed. Such a method is complicate. In order to form holes in the quilting, the manufacturing method becomes further complicated.

The present invention has been made in view of the above circumstances, and an object thereof is to provide a warp knitting machine capable of forming irregularities conforming to a pattern in a warp knitted fabric, a method of manufacturing the warp knitted fabric having irregularities conforming to the pattern, the warp knitted fabric having irregularities conforming to the pattern, and a shoe upper having irregularities conforming to the pattern.

Means for Solving the Problem

According to a present embodiment, a warp knitting machine as a double raschel machine includes: a pair of jacquard bars at a front side, a pair of jacquard bars at a back side, at least one guide bar in front of the pair of jacquard bars at the front side, and at least one guide bar in back of the pair of jacquard bars at the back side, the warp knitting machine characterized by including at least one guide bar between the pair of jacquard bars at the front side and the pair of jacquard bars at the back side.

According to the present embodiment, a method of manufacturing a warp knitted fabric includes: knitting a front-side base fabric and a back-side base fabric using a double raschel machine including a pair of jacquard bars at a front side and a pair of jacquard bars at a back side; and forming a jacquard pattern in the front-side base fabric and the back-side base fabric using jacquard yarns fed from the respective jacquard bars by operating jacquard mechanisms of the pair of jacquard bars at the front side and the pair of jacquard bars at the back side, respectively. The method of manufacturing the warp knitted fabric is characterized in that: a joining position where the front-side base fabric is joined to the back-side base fabric by the jacquard yarns due to an operation of the jacquard mechanisms, and a non-joining position where the front-side base fabric is not joined to the back-side base fabric are provided; insertion yarns are inserted between the front-side base fabric and the back-side base fabric by at least one guide bar disposed between the pair of jacquard bars at the front side, and the pair of jacquard bars at the back side; and the insertion yarns are pressed at the joining position of the front-side base fabric and the back-side base fabric.

According to the present embodiment, a warp knitted fabric has a jacquard pattern formed by jacquard yarns in a front-side base fabric and a back-side base fabric. The warp knitted fabric is characterized in that: a joining position where the front-side base fabric is joined to the back-side base fabric by the jacquard yarns, and a non-joining position where the front-side base fabric is not joined to the back-side base fabric are provided; insertion yarns are inserted between the front-side base fabric and the back-side base fabric; and the insertion yarns are pressed at the joining position of the front-side base fabric and the back-side base fabric.

According to the present embodiment, a shoe upper includes the warp knitted fabric.

Advantage of the Invention

According to the warp knitting machine of the present embodiment, insertion yarns may be inserted between the front-side base fabric and the back-side base fabric in the warp knitted fabric. Thus, the method of manufacturing the warp knitted fabric according to the present embodiment may be performed.

According to the method of manufacturing the warp knitted fabric according to the present embodiment, insertion yarns are inserted between the front-side base fabric and the back-side base fabric, and the insertion yarns are pressed at a position where the front-side base fabric is joined to the back-side base fabric by jacquard yarns, thereby forming irregularities conforming to a pattern in the warp knitted fabric.

In the warp knitted fabric and the shoe upper according to the present embodiment, irregularities conforming to a pattern are formed.

BRIEF DESCRIPTION OF THE DRAWINGS

FIGS. 2A-2F are knit texture views of a first embodiment, in which FIG. 2A is a knit texture formed by a guide bar GB2, FIG. 2B is a basic texture formed by front jacquard bars JB3 and JB4, FIG. 2C is a knit texture formed by a guide bar GB5, FIG. 2D is a basic texture formed by back jacquard bars JB6 and JB7, FIG. 2E is a knit texture formed by a guide bar GB8, and FIG. 2F is a knit texture formed by a guide bar GB9;

FIGS. 3A-3E are views of a knit texture formed by the front jacquard bars JB3 and JB4 in the first embodiment, in which FIG. 3A is a thick cloth texture, FIG. 3B is a thin cloth texture, FIG. 3C is a hole texture, FIG. 3D is a texture in the case of overlapping with respect to the back-side row of knitting needles BN, and FIG. 3E is a texture in the case of overlapping with respect to the back-side row of knitting needles BN;

FIGS. 4A-4E are views of a knit texture formed by the back jacquard bars JB6 and JB7 in the first embodiment, in which FIG. 4A is a thick cloth texture, FIG. 4B is a thin cloth texture, FIG. 4C is a hole texture, FIG. 4D is a knit texture in the case of overlapping with respect to the front-side row of knitting needles FN, and FIG. 4E is a knit texture in the case of overlapping with respect to the front-side row of knitting needles FN;

FIGS. 7A-7F are knit texture views in a second embodiment, in which FIG. 7A is a knit texture formed by the guide bar GB2, FIG. 7B is a basic texture formed by the front jacquard bars JB3 and JB4, FIG. 7C is a knit texture formed by the guide bar GB5, FIG. 7D is a basic texture formed by the back jacquard bars JB6 and JB7, FIG. 7E is a knit texture formed by the guide bar GB8, and FIG. 7F is a knit texture formed by the guide bar GB9;

FIGS. 8A-8E are views of a knit texture formed by the front jacquard bars JB3 and JB4 in the second embodiment, in which FIG. 8A is a front thick cloth texture, FIG. 8B is a knit texture in the case of overlapping with respect to the front-side row of knitting needles FN and the back-side row of knitting needles BN, FIG. 8C is a back thin cloth texture, FIG. 8D is a hole texture, and FIG. 8E is another hole texture;

FIGS. 9A-9E are views of a knit texture formed by the back jacquard bars JB6 and JB7 in the second embodiment, in which FIG. 9A is a back thick cloth texture, FIG. 9B is a knit texture in the case of overlapping with respect to the front-side row of knitting needles FN and the back-side row of knitting needles BN, FIG. 9C is a front thin cloth texture, FIG. 9D is a hole texture, and FIG. 9E is another hole texture;

FIG. 11 is a FIGS. 11A-11F are knit texture views in a third embodiment, in which

FIGS. 12A-12C are views of a knit texture formed by the front jacquard bars JB3 and JB4 in the third embodiment, in which FIG. 12A is a knit texture in the case of overlapping with respect to the front-side row of knitting needles FN, FIG. 12B is a knit texture in the case of overlapping with respect to the back-side row of knitting needles BN, and FIG. 12C is a hole texture;

FIGS. 13A-13C are views of a knit texture formed by the back jacquard bars JB6 and JB7 in the third embodiment, in which FIG. 13A is a knit texture in the case of overlapping with respect to the back-side row of knitting needles BN, FIG. 13B is a knit texture in the case of overlapping with respect to the front-side row of knitting needles FN, and FIG. 13C is a hole texture.

BEST MODE FOR CARRYING OUT THE INVENTION

The present embodiment will be described with reference to drawings. The present embodiment is exemplary only, and it is assumed that those properly modified without departing from the gist of the present invention are included in the scope of the present invention.

1. First Embodiment (1) Structure of Warp Knitting Machine

The warp knitting machine according to the first embodiment is a so-called double raschel machine including a front-side row of knitting needles FN and a back-side row of knitting needles BN, in which a front-side base fabric 1 is knitted by the front-side row of knitting needles FN, and a back-side base fabric 2 is knitted by the back-side row of knitting needles BN, and further, the front-side base fabric 1 and the back-side base fabric 2 are joined at a position of at least a part of the base fabrics. Each of the front-side row of knitting needles FN and the back-side row of knitting needles BN includes a plurality of knitting needles aligned in the width direction of the double raschel machine. A gauge is, for example, 24 E (24 knitting needles per inch).

Figure 1:
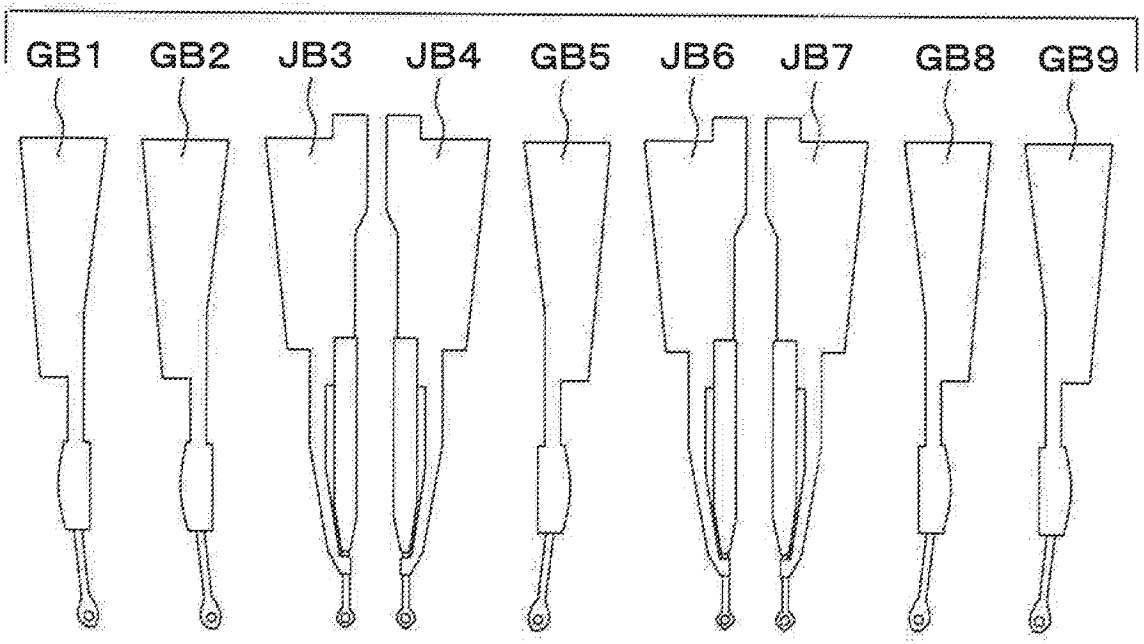
FIG. 1 is a side view of guide bars and jacquard bars of a double raschel machine according to an embodiment.
Figure 1A:
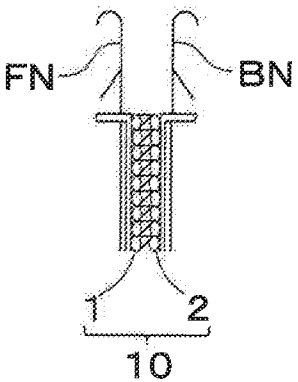
FIG. 1A is a side view of needles of the double rashel machine and fabric.

The double raschel machine of the first embodiment, as illustrated in FIG. 1 and FIG. 1A, is a so-called double jacquard double raschel machine including a front-side pair of jacquard bars JB3 and JB4 (hereinafter, "front jacquard bars JB3 and JB4"), and a back-side pair of jacquard bars JB6 and JB7 (hereinafter, "back jacquard bars JB6 and JB7").

Each of the jacquard bars JB3, JB4, JB6, and JB7 performs a basic movement to knit a basic texture. Accordingly, a plurality of jacquard guides provided in each of the jacquard bars JB3, JB4, JB6, and JB7 perform basic movements to knit the basic texture.

Each of these jacquard guides not only performs the basic movement to knit the basic texture, but also may be displaced independently by the action of the jacquard mechanism. Therefore, the plurality of jacquard guides may perform different movements. When the jacquard mechanism acts, the jacquard guide is displaced by a distance of 1 G (a distance between two adjacent knitting needles) from a position where the basic texture is being knitted. The direction of displacement in jacquard guides of the front jacquard bars JB3 and JB4 is leftward and the direction of displacement in jacquard guides of the back jacquard bars JB6 and JB7 is rightward. The jacquard mechanism may be allowed to act at the time of either or both overlapping and underlapping.

The double raschel machine of the first embodiment includes at least one guide bar in front of the front jacquard bars JB3 and JB4, and at least one guide bar in back of the back jacquard bars JB6 and JB7.

In FIG. 1, as a guide bar in front of the front jacquard bars JB3 and JB4, two guide bars GB1 and GB2 are provided, and as a guide bar in back of the back jacquard bars JB6 and JB7, two guide bars GB8 and GB9 are provided. Meanwhile, in the knitting of a warp knitted fabric 10, at least any one of the front-side two guide bars GB1 and GB2 may be used, and it is not necessary to use the two guide bars. In the knitting of the warp knitted fabric 10, at least any one of the back-side two guide bars GB8 and GB9 may be used, and it is not necessary to use the two guide bars.

Further, the double raschel machine of the first embodiment includes at least one guide bar between the front jacquard bars JB3 and JB4, and the back jacquard bars JB6 and JB7. In FIG. 1, as such a guide bar, one guide bar GB5 is provided.

Each of the guide bars GB1, GB2, GB5, GB8, and GB9 performs a basic movement to knit a knit texture. Unlike the jacquard guides, the plurality of guides provided in each of the guide bars GB1, GB2, GB5, GB8, and GB9 are not capable of performing different movements from other guides provided in the same guide bar.

The number of guides in each of the guide bars GB1, GB2, GB5, GB8, and GB9, per inch, is the same as the number of knitting needles per inch. Then, in each of the guide bars GB1, GB2, GB5, GB8, and GB9, each guide is arranged at a position corresponding to each knitting needle.

Meanwhile, each of the jacquard bars JB3, JB4, JB6, and JB7 is a half-gauge jacquard bar. Then, when two jacquard bars are paired, one pair has a full-gauge as a whole. That is, in each of the jacquard bars JB3, JB4, JB6, and JB7, the number of jacquard guides per inch is the half of the number of knitting needles per inch, and one jacquard guide is arranged for every two knitting needles. Here, between the pair of two jacquard bars, the position of a jacquard guide is shifted by one knitting needle. Then, as the two jacquard bars are paired, jacquard guides corresponding to the number of knitting needles are provided, and each guide is arranged at a position corresponding to each knitting needle.

Accordingly, as the jacquard bars JB3 and JB4 are paired, jacquard guides corresponding to the number of knitting needles are provided, and are arranged at positions corresponding to the knitting needles, respectively. As the jacquard bars JB6 and JB7 are paired, jacquard guides corresponding to the number of knitting needles are provided, and are arranged at positions corresponding to the knitting needles, respectively.

In the above described guide bar arrangement, the guide bar GB1 to the back jacquard bars JB6 and JB7 may overlap the front-side row of knitting needles FN, and the front jacquard bars JB3 and JB4 to the guide bar GB9 may overlap the back-side row of knitting needles BN.

Except for the above structure, the warp knitting machine of the first embodiment has the same structure as the conventionally known double raschel machine.

(2) Manufacturing Method of Warp Knitted Fabric 10

In the double raschel machine having the above structure, the front-side base fabric 1 is knitted by at least one of the guide bars GB1 and GB2 in front of the front jacquard bars JB3 and JB4. The back-side base fabric 2 is knitted by at least one of the guide bars GB8 and GB9 in back of the back jacquard bars JB6 and JB7.

In parallel with the knitting of the front-side base fabric 1 and the back-side base fabric 2, as jacquard mechanisms of the front jacquard bars JB3 and JB4 and the back jacquard bars JB6 and JB7 act, respectively, jacquard yarns fed from the front jacquard bars JB3 and JB4 (hereinafter, referred to as "front jacquard yarns") and jacquard yarns fed from the back jacquard bars JB6 and JB7 (hereinafter, referred to as "back jacquard yarns") are knitted into the front-side base fabric 1 and the back-side base fabric 2. The jacquard yarns knitted into the front-side base fabric 1 and the back-side base fabric 2 appear on the surface of these base fabrics to forma jacquard pattern.

The jacquard pattern refers to a pattern formed by jacquard yarns appearing on the surface of the warp knitted fabric 10.

Further, in parallel with the formation of the jacquard pattern, as jacquard mechanisms of the front jacquard bars JB3 and JB4 and the back jacquard bars JB6 and JB7 act, respectively, the front jacquard yarns and the back jacquard yarns join the front-side base fabric 1 to the back-side base fabric 2 on at least a part of the warp knitted fabric 10.

Here, the joining position of the front-side base fabric 1 and the back-side base fabric 2 and a position (a non-joining position) excluding the joining position are formed by the jacquard yarns, and thus correspond to constituent elements of the jacquard pattern appearing on the surface of the warp knitted fabric 10, respectively. For example, in the case where the front jacquard yarns are knitted into the back-side base fabric 2 and the back jacquard yarns are knitted into the front-side base fabric 1 to form the joining position, the back jacquard yarns appear on the surface of the front-side base fabric 1, and becomes a constituent element of the jacquard pattern on the front-side surface of the warp knitted fabric 10.

Each of the joining position and the non-joining position may extend over a plurality of courses and a plurality of wales.

Further, in parallel with the formation or the like of the jacquard pattern, the guide bar GB5 between the front jacquard bars JB3 and JB4 and the back jacquard bars JB6 and JB7 inserts insertion yarns between the front-side base fabric 1 and the back-side base fabric 2. The insertion yarns inserted by the guide bar GB5 are compressed by being pressed from the front-side base fabric 1 and the back-side base fabric 2 at the joining position of the front-side base fabric 1 and the back-side base fabric 2. Meanwhile, at the non-joining position of the front-side base fabric 1 and the back-side base fabric 2, the insertion yarns inserted by the guide bar GB5 are not pressed from the front-side base fabric 1 and the back-side base fabric 2, and then are not compressed. Thus, the portion composed of the non-joining position bulges as compared to the portion composed of the joining position.

As a result of the knitting as described above, on the surface of the warp knitted fabric 10, the portion composed of the joining position becomes a concave portion, and the portion composed of the non-joining position bulges to become a convex portion. Since the joining position and the non-joining position are related to the jacquard pattern appearing on the surface of the warp knitted fabric 10, irregularities conforming to the jacquard pattern are formed on the warp knitted fabric 10.

In a preferred embodiment, a chain stitch texture is formed on the front-side base fabric 1 by the front-side guide bar GB1 or GB2, and a chain stitch texture is formed on the back-side base fabric 2 by the back-side guide bar GB8 or GB9. As the jacquard mechanisms act, in each of the front-side base fabric 1 and the back-side base fabric 2, a position where adjacent wales of the chain stitch texture are joined by the front jacquard yarns and the back jacquard yarns, and a position where the adjacent wales are not joined are formed. Further, when the position where the adjacent wales are not joined in the front-side base fabric 1 coincides with the position where the adjacent wales are not joined in the back-side base fabric 2 in the front-back direction (a direction perpendicular to the surface of the warp knitted fabric 10, that is, the front-back direction of the warp knitted fabric 10), a hole penetrating the warp knitted fabric 10 is formed at the corresponding position.

(3) Specific Knitting Example 1

A knitting example of the warp knitted fabric 10 described above will be described. In the knitting example, the warp knitted fabric 10 is used for, for example, a shoe upper.

A knit texture view of the knitting example is illustrated in FIGS. 2A-2F. In each knit texture view, F indicates a course knitted by the front-side row of knitting needles FN, and B indicates a course knitted by the back-side row of knitting needles BN. In the first embodiment, the guide bars GB2, GB5, GB8, and GB9, and the jacquard bars JB3, JB4, JB6, and JB7 are used for the knitting.

In the knitting, to each of the guide bars GB2, GB5, GB8, and GB9, yarns are fed to form a full set. That is, in each of the guide bars GB2, GB5, GB8, and GB9, yarns are fed to all guides. Accordingly, yarns corresponding to the number of knitting needles included in one row of knitting needles are fed to each of the guide bars GB2, GB5, GB8, and GB9.

To the front jacquard bars JB3 and JB4 and the back jacquard bars JB6 and JB7 as well, yarns are fed to form full sets, respectively. That is, in each of the jacquard bars JB3, JB4, JB6, and JB7, yarns are fed to all jacquard guides. Accordingly, yarns corresponding to the number of knitting needles included in one row of knitting needles are fed to the front jacquard bars JB3 and JB4 as a whole. Yarns corresponding to the number of knitting needles included in one row of knitting needles are fed to the back jacquard bars JB6 and JB7 as a whole.

Figures 2A, 2B, 2C, 2D, 2E, 2F:
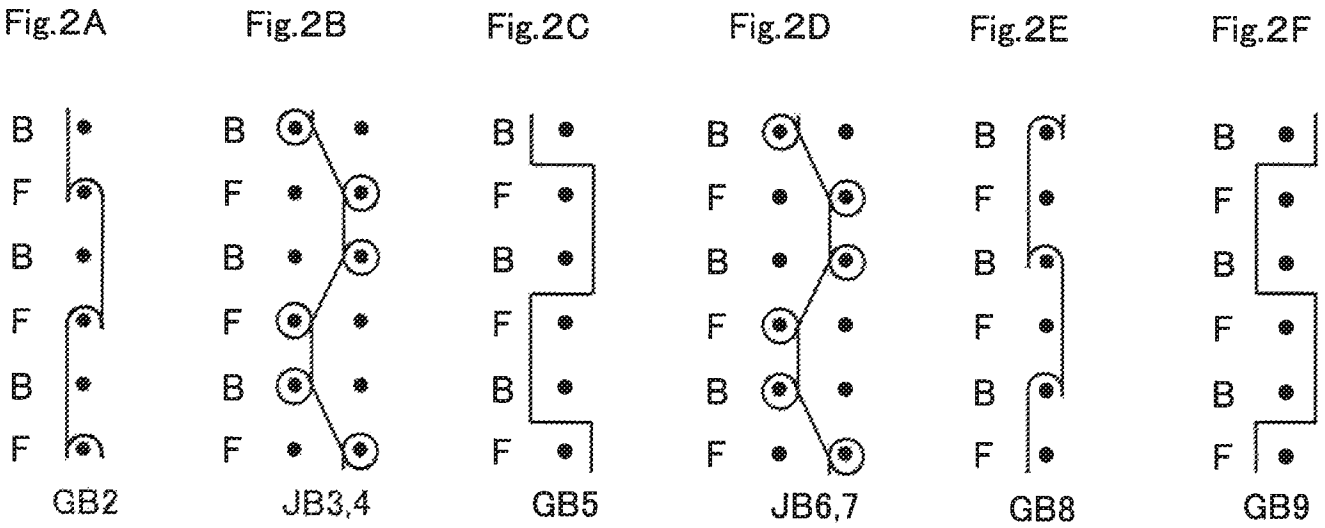

As illustrated in FIG. 2A, the knit texture of the guide bar GB2 is a chain stitch texture in which stitches are formed in the same wale, and is composed of repetition units of 0-1/1-1/1-0/0-0//.

In such a notation, odd-numbered items (0-1 and 1-0 in the above example) indicate the action on the knitting needles of the front-side row of knitting needles FN, and even-numbered items (1-1 and 0-0 in the above example) indicate the action on the knitting needles of the back-side row of knitting needles BN.

The knit texture of the guide bar GB5 as illustrated in FIG. 2C is an insertion texture and is composed of repetition units of 0-0/1-1/1-1/0-0//. The knit texture of the guide bar GB8 as illustrated in FIG. 2E is a chain stitch texture, and is composed of repetition units of 1-1/1-0/0-0/0-1//. The knit texture of the guide bar GB9 as illustrated in FIG. 2F is an insertion texture and is composed of repetition units of 1-1/0-0/0-0/1-1//.

In this manner, stitches are formed in all wales and courses of the front-side base fabric 1 and the back-side base fabric 2 by the guide bar GB2 and the guide bar GB8. Here, since the knit textures formed by the guide bar GB2 and the guide bar GB8 are chain stitch textures, adjacent wales are not joined without jacquard yarns. As described below, the jacquard yarns join the adjacent wales.

The insertion yarns inserted by the guide bar GB5 serve a role of swelling the warp knitted fabric 10 as described below. The insertion yarns inserted by the guide bar GB9 serve a role of reinforcing the warp knitted fabric 10.

FIGS. 2B and 2D also illustrates basic textures formed by the jacquard bars JB3, JB4, JB6, and JB7, that is, knit textures formed by the jacquard bars JB3, JB4, JB6, and JB7 when the jacquard mechanism does not work. The basic texture formed by the front jacquard bars JB3 and JB4 as illustrated in FIG. 2B is composed of repetition units of 1-0/1-2/1-2/1-0//. The basic texture formed by the back jacquard bars JB6 and JB7 as illustrated in FIG. 2D is composed of repetition units of 1-0/1-2/1-2/1-0//.

In FIG. 3 FIGS. 3A-3E, the above described basic texture formed by the front jacquard bars JB3 and JB4 is indicated by a broken line, and an example of a knit texture formed by the front jacquard bars JB3 and JB4 is indicated by a solid line when the jacquard mechanism acts.

In each knit texture view, "H" in the drawing indicates that the jacquard mechanism is not caused to act. In this case, a jacquard guide is placed at the same position as that when the basic texture is knitted. "T" in the drawing indicates that the jacquard mechanism is caused to act. In this case, the jacquard guide is displaced from a position where the basic texture is knitted. "T" and "H" are described at upper and lower ends of one needle position. Meanwhile, "T" or "H" at the upper end indicates that the jacquard mechanism is allowed or not allowed to act at the time of overlapping, and "T" or "H" at the lower end indicates that the jacquard mechanism is allowed or not allowed to act at the time of underlapping.

Figure 3A:
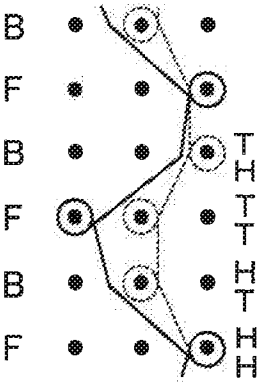
Figure 3B:
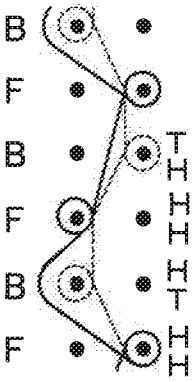

In FIGS. 3A and 3B, an example of a knit texture is illustrated in which the front jacquard bars JB3 and JB4 overlap the front-side row of knitting needles FN due to the action of the jacquard mechanism. The knit texture in FIG. 3A is one called a thick cloth texture, and is composed of repetition units of 1-0/2-2/2-3/1-1//. The knit texture in FIG. 3B is one called a thin cloth texture, and is composed of repetition units of 1-0/2-2/1-2/1-1//.

As described above, the front jacquard bars JB3 and JB4 overlap the front-side row of knitting needles FN so that the front-side base fabric 1 is formed by the front jacquard yarns and yarns fed from and the guide bar GB2. Here, the front jacquard yarns appear on the surface of the front-side base fabric 1 (the front-side surface of the warp knitted fabric 10).

Here, the front jacquard yarns reciprocate between three needles in the wale direction (weft direction) in one repetition unit while forming a needle loop when the thick cloth texture in FIG. 3A is knitted, and reciprocate between two needles in the wale direction in one repetition unit while forming a needle loop when the thin cloth texture in FIG. 3B is knitted. Therefore, the front jacquard yarns join different wales of the chain stitch texture formed by the yarns fed from the guide bar GB2. The thick cloth texture in FIG. 3A is larger in racking width in the wale direction (weft direction) than the thin cloth texture in FIG. 3B, and thus thickens the front-side base fabric 1 by the larger width.

Figure 3C:
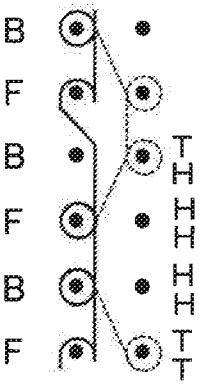

In FIG. 3C, an example of a knit texture is illustrated in which the front jacquard bars JB3 and JB4 wrap within the same wale due to the action of the jacquard mechanism. The knit texture in FIG. 3C is one called a hole texture, and is composed of repetition units of 1-0/0-1/0-1/0-0//.

The front jacquard yarns do not join adjacent wales of the chain stitch texture formed by the yarns fed from the guide bars GB2 and GB8 when the hole texture in FIG. 3C is knitted. In the hole texture in FIG. 3C, the front jacquard bars JB3 and JB4 overlap the front-side row of knitting needles FN and the back-side row of knitting needles BN, and the front jacquard yarns are knitted into the front-side base fabric 1 and the back-side base fabric 2. Therefore, the front-side base fabric 1 is joined to the back-side base fabric 2.

Figure 3D:
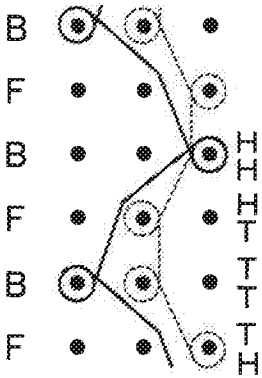
Figure 3E:
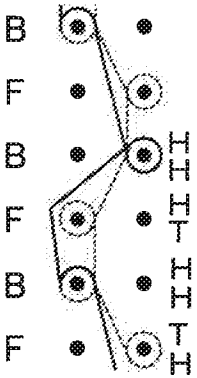

In FIGS. 3D and 3E, an example of a knit texture is illustrated in which the front jacquard bars JB3 and JB4 overlap the back-side row of knitting needles BN due to the action of the jacquard mechanism. The knit texture in FIG. 3D is composed of repetition units of 1-1/2-3/2-2/1-0//. The knit texture in FIG. 3E is composed of repetition units of 1-1/1-2/2-2/1-0//.

As described above, the front jacquard bars JB3 and JB4 overlap the back-side row of knitting needles BN so that the front jacquard yarns are knitted into the back-side base fabric 2. Here, the front jacquard yarns appear on the surface of the back-side base fabric 2 (the back-side surface of the warp knitted fabric 10).

Here, the front jacquard yarns reciprocate between three needles in the wale direction in one repetition unit while forming a needle loop when the knit texture in FIG. 3D is knitted, and reciprocate between two needles in the wale direction in one repetition unit while forming a needle loop when the knit texture in FIG. 3E is knitted. Therefore, the front jacquard yarns join different wales of the chain stitch texture formed by the yarns fed from the guide bar GB8. The knit texture in FIG. 3D is larger in racking width in the wale direction (weft direction) than the knit texture in FIG. 3E, and thus thickens the back-side base fabric 2 by the larger width.

In FIGS. 4A-4E, the above described basic texture formed by the back jacquard bars JB6 and JB7 is indicated by a broken line, and an example of a knit texture formed by the back jacquard bars JB6 and JB7 is indicated by a solid line when the jacquard mechanism acts.

Figure 4A:
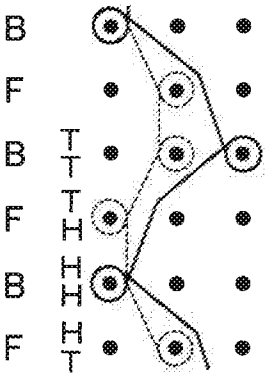
Figure 4B:
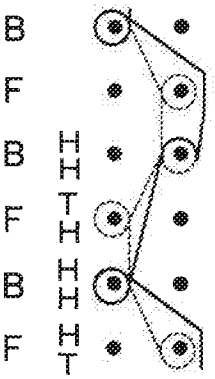

In FIGS. 4A and 4B, an example of a knit texture is illustrated in which the back jacquard bars JB6 and JB7 overlap the back-side row of knitting needles BN due to the action of the jacquard mechanism. The knit texture in FIG. 4A is one called a thick cloth texture, and is composed of repetition units of 1-1/2-3/2-2/1-0//. The knit texture in FIG. 4BC is one called a thin cloth texture, and is composed of repetition units of 0-0/1-2/1-1/1-0//.

As described above, the back jacquard bars JB6 and JB7 overlap the back-side row of knitting needles BN so that the back-side base fabric 2 is formed by the back jacquard yarns and yarns fed from the guide bars GB8 and GB9. Here, the back jacquard yarns appear on the surface of the back-side base fabric 2 (the back-side surface of the warp knitted fabric 10).

Here, the back jacquard yarns reciprocate between three needles in the wale direction in one repetition unit while forming a needle loop when the thick cloth texture in FIG. 4A is knitted, and reciprocate between two needles in the wale direction in one repetition unit while forming a needle loop when the thin cloth texture in FIG. 4B is knitted. Therefore, the jacquard yarns fed from the back jacquard bars JB6 and JB7 join different wales of the chain stitch texture formed by the yarns fed from the guide bar GB8. The thick cloth texture in FIG. 4A is larger in racking width in the wale direction (weft direction) than the thin cloth texture in FIG. 4B, and thus thickens the back-side base fabric 2 by the larger width.

Figure 4C:
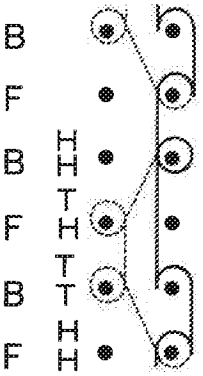

In FIG. 4C, an example of a knit texture is illustrated in which the back jacquard bars JB6 and JB7 wrap within the same wale due to the action of the jacquard mechanism. The knit texture in FIG. 4C is one called a hole texture, and is composed of repetition units of 1-0/0-1/1-1/1-0//.

The back jacquard yarns do not join adjacent wales of the chain stitch texture formed by the yarns fed from the guide bars GB2 and GB8 when the hole texture in FIG. 4C is knitted. In the hole texture in FIG. 4C, the back jacquard bars JB6 and JB7 overlap the front-side row of knitting needles FN and the back-side row of knitting needles BN, and the back jacquard yarns are knitted into the front-side base fabric 1 and the back-side base fabric 2. Therefore, the front-side base fabric 1 is joined to the back-side base fabric 2.

Figure 4D:
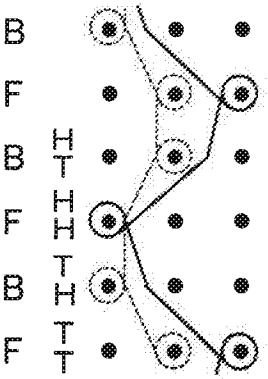
Figure 4E:
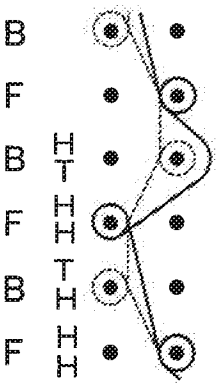

In FIGS. 4D and 4E, an example of a knit texture is illustrated in which the back jacquard bars JB6 and JB7 overlap the front-side row of knitting needles FN due to the action of the jacquard mechanism. The knit texture in FIG. 4D is composed of repetition units of 1-0/2-2/2-3/1-1//. The knit texture in FIG. 4E is composed of repetition units of 1-0/1-1/1-2/0-0//.

As described above, the back jacquard bars JB6 and JB7 overlap the front-side row of knitting needles FN so that the back jacquard yarns are knitted into the front-side base fabric 1. Here, the back jacquard yarns appear on the surface of the front-side base fabric 1 (the front-side surface of the warp knitted fabric 10).

Here, the back jacquard yarns reciprocate between three needles in the wale direction in one repetition unit while forming a needle loop when the knit texture in FIG. 4D is knitted, and reciprocate between two needles in the wale direction in one repetition unit while forming a needle loop when the knit texture in FIG. 4E is knitted. Therefore, the back jacquard yarns join different wales of the chain stitch texture formed by the yarns fed from the guide bar GB2. The knit texture in FIG. 4D is larger in racking width in the wale direction (weft direction) than the knit texture in FIG. 4D, and thus thickens the front-side base fabric 1 by the larger width.

In the first embodiment, one of knit textures in FIGS. 3A to 3E is selected as a knit texture formed by the front jacquard bars JB3 and JB4 at each knitting position. At the same time, one of knit textures in FIGS. 4A to 4E is selected as a knit texture formed by the back jacquard bars JB6 and JB7 at each knitting position. In this manner, at each knitting position, a combination of the knit texture formed by the front jacquard bars JB3 and JB4 and the knit texture formed by the back jacquard bars JB6 and JB7 is realized.

Depending on the combination, a hole may be formed in the warp knitted fabric 10, or a specific yarn may be caused to appear on the front-side or back-side surface of the warp knitted fabric 10. Then, by changing a combination for each knitting position, a jacquard pattern may be formed on the front-side or back-side surface of the warp knitted fabric 10. Irregularities matching the jacquard pattern may be formed.

For example, as a knit texture formed by the front jacquard bars JB3 and JB4 at a certain position, the knit texture in the case of overlapping with respect to the front-side row of knitting needles FN as illustrated in FIGS. 3A to 3E is selected, and as a knit texture formed by the back jacquard bars JB6 and JB7 at the same position, the knit texture in the case of overlapping with respect to the back-side row of knitting needles BN as illustrated in FIG. 4A or 4B is selected. In this case, the front jacquard yarns appear on the front-side surface of the warp knitted fabric 10, and the back jacquard yarns appear on the back-side surface. In this case, the front-side base fabric 1 is not joined to the back-side base fabric 2.

As a knit texture formed by the front jacquard bars JB3 and JB4 at another position, the knit texture in the case of overlapping with respect to the back-side row of knitting needles BN as illustrated in FIG. 3D or FIG. 3E is selected, and as a knit texture formed by the back jacquard bars JB6 and JB7 at the same position, the knit texture in the case of overlapping with respect to the front-side row of knitting needles FN as illustrated in FIG. 4D or FIG. 4E is selected. In this case, the back jacquard yarns mainly appear on the front-side surface of the warp knitted fabric 10, and the front jacquard yarns mainly appear on the back-side surface. In this case, overlapping of the front jacquard bars JB3 and JB4 with respect to the back-side row of knitting needles BN, and overlapping of the pair of back jacquard bars JB6 and JB7 at the back side with respect to the front-side row of knitting needles FN are alternately performed, and sinker loops of the front jacquard yarns and sinker loops of the back jacquard yarns intersect and get entangled with each other. Thus, the front-side base fabric 1 and the back-side base fabric 2 are joined to each other while mutually attracting each other.

In this manner, on the front-side surface of the warp knitted fabric 10, a portion in which the front jacquard yarns appear and a portion in which the back jacquard yarns appear are formed. Then, when different types of yarns are fed to the front jacquard bars JB3 and JB4 and the back jacquard bars JB6 and JB7, a jacquard pattern is formed on the front-side surface of the warp knitted fabric 10. Similarly, on the back-side surface of the warp knitted fabric 10, a portion in which the front jacquard yarns appear and a portion in which the back jacquard yarns appear are formed. Then, when different types of yarns are fed to the front jacquard bars JB3 and JB4 and the back jacquard bars JB6 and JB7, a jacquard pattern is formed on the back-side surface of the warp knitted fabric 10.

The different types of yarns refer to yarns different in at least any one of color, glossiness, ease of dyeing, feel and the like.

Meanwhile, the insertion yarns inserted by the guide bar GB5 are inserted between the front-side base fabric 1 and the back-side base fabric 2. Then, at the above described joining position where the front-side base fabric 1 is joined to the back-side base fabric 2, the insertion yarns inserted by the guide bar GB5 are compressed by being pressed from the front-side base fabric 1 and the back-side base fabric 2. Thus, at the portion composed of the above described joining position of the front-side base fabric 1 and the back-side base fabric 2, the warp knitted fabric 10 does not bulge toward the front side or the back side.

Meanwhile, at the non-joining position where the front-side base fabric 1 is not joined to the back-side base fabric 2, the insertion yarns inserted by the guide bar GB5 are not pressed from the front-side base fabric 1 and the back-side base fabric 2 and then are not compressed. Thus, at the portion composed of the non-joining position of the front-side base fabric 1 and the back-side base fabric 2, the warp knitted fabric 10 bulges toward at least one of the front side and the back side.

In this manner, on the surface of the warp knitted fabric 10, irregularities composed of a non-bulging portion, that is, a concave portion, and a bulging portion, that is, a convex portion, are formed according to the jacquard pattern.

Figure 5:
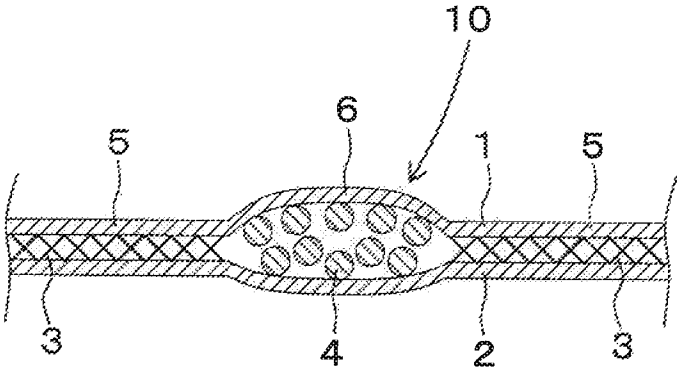
FIG. 5 is a sectional view of a warp knitted fabric 10.

For reference, FIG. 5 illustrates a state where the irregularities are formed on the warp knitted fabric 10. As illustrated, at a joining position 5 where the front-side base fabric 1 is joined to the back-side base fabric 2 by jacquard yarns 3, insertion yarns (not illustrated) inserted by the guide bar GB5 are compressed by being pressed from the front-side base fabric 1 and the back-side base fabric 2. Meanwhile, at a non-joining position 6 where the front-side base fabric 1 is not joined to the back-side base fabric 2 by the jacquard yarns 3, insertion yarns 4 are not compressed, and the warp knitted fabric 10 bulges. In this manner, the bulging position and the non-bulging position are formed, thereby forming irregularities on the warp knitted fabric 10.

At the bulging portion where the front-side base fabric 1 is not joined to the back-side base fabric 2, when sinker loops of jacquard yarns in any one of the front-side base fabric 1 and the back-side base fabric 2 is longer than sinker loops of jacquard yarns in the other base fabric, the warp knitted fabric 10 bulges more largely at the base fabric side with the longer sinker loops.

For example, as a knit texture formed by the front jacquard bars JB3 and JB4, the thick cloth texture in FIG. 3A in which stitches are formed on the front-side base fabric 1, and yarns reciprocate between three needles in the wale direction is selected. At the same time, as a knit texture formed by the back jacquard bars JB6 and JB7, the thin cloth texture in FIG. 4B in which stitches are formed on the back-side base fabric 2, and yarns reciprocate between two needles in the wale direction is selected. In this case, since sinker loops of jacquard yarns in the front-side base fabric 1 is longer than sinker loops of jacquard yarns in the back-side base fabric 2, the warp knitted fabric 10 bulges more largely toward the front side.

As a knit texture formed by the front jacquard bars JB3 and JB4 at a certain position, the hole texture in FIG. 3C is selected, and as a knit texture formed by the back jacquard bars JB6 and JB7 at the same position, the hole texture in FIG. 4C is selected. Accordingly, the non-joining position in the front-side base fabric 1, where adjacent wales are not joined, coincides with the non-joining position in the back-side base fabric 2, where adjacent wales are not joined, in the front-back direction, and a hole is formed at the corresponding position in the warp knitted fabric 10. Here, the hole texture in FIG. 3C and the hole texture in FIG. 4C join the front-side base fabric 1 to the back-side base fabric 2 as described above, and thus the front-side base fabric 1 is joined to the back-side base fabric 2 at the opening end of the hole.

The material or thickness (fineness) of a yarn used in the first embodiment is not limited. As the yarn, various yarns such as a filament yarn or a spun yarn may be employed. As the material of the yarn, natural fibers made of silk or cotton, synthetic fibers made of polyester or nylon, or the like may be employed.

When the thickness of the insertion yarn inserted by the guide bar GB5 is changed, the bulging amount of the warp knitted fabric 10 is changed. In order to increase the bulging amount of the warp knitted fabric 10, the insertion yarn to be fed to the guide bar GB5 may be thicker than other yarns, and further, its constant length system yarn count (dtex) may be three times or more the jacquard yarn.

For example, a polyester yarn of 100 dtex or less is fed to the guide bars GB2 and GB8, a polyester yarn ranging from 100 dtex to 200 dtex is fed to the guide bar GB9, a polyester yarn ranging from 100 dtex to 200 dtex is fed to the jacquard bars JB3, JB4, JB6, and JB7, and a polyester yarn ranging from 500 dtex to 700 dtex is fed to the guide bar GB5.

Regarding the material or thickness of the yarn, it can be said that those as described above may be applied in second and third embodiments as described below.

(4) Specific Example of Warp Knitted Fabric 10

Figure 6:
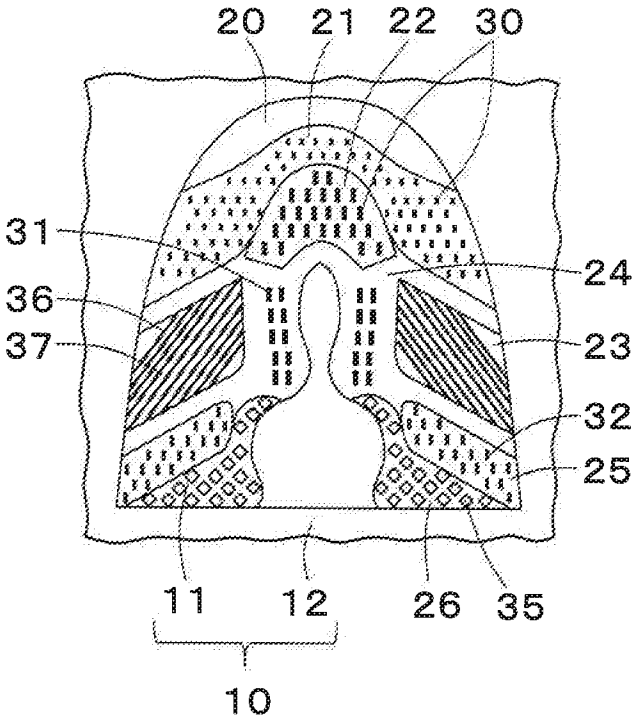
FIG. 6 is a view illustrating a front-side surface of the warp knitted fabric 10 knitted in the first embodiment.

The front-side surface of the warp knitted fabric 10 knitted in the knitting example 1 is illustrated in FIG. 6. The warp knitted fabric 10 is formed by integrally knitting an upper part 11 and a peripheral part 12 thereof used for a shoe upper. The upper part 11 includes a pattern composed of a toe portion 20, a front portion 21, an instep portion 22, a side portion 23, a top portion 24, a rear portion 25, and a heel portion 26.

In the knitting of the warp knitted fabric 10 as described below, it is assumed that orange yarns are fed to the front jacquard bars JB3 and JB4, and white yarns are fed to the guide bars GB2, GB5, GB8, and GB9 and the back jacquard bars JB6 and JB7.

In the upper part 11 and the peripheral part 12, the knit textures in FIG. 2 are formed by the guide bars GB2, GB5, GB8, and GB9. The knit textures to be described below are formed by the front jacquard bars JB3 and JB4 and the back jacquard bars JB6 and JB7.

In the toe portion 20, the thick cloth texture in FIG. 3A is formed by the front jacquard bars JB3 and JB4, and the thin cloth texture in FIG. 4B is formed by the back jacquard bars JB6 and JB7. Therefore, the front-side surface of the toe portion 20 has an orange color which is a color of the yarns fed from the front jacquard bars JB3 and JB4. Since the front-side base fabric 1 is not joined to the back-side base fabric 2, the toe portion 20 bulges to become a convex portion.

In the front portion 21 and the instep portion 22, the knit texture in FIG. 3D is formed by the front jacquard bars JB3 and JB4, and the knit texture in FIG. 4D is formed by the back jacquard bars JB6 and JB7. Therefore, the front-side surface of the front portion 21 and the instep portion 22 has a white color which is a color of the yarns fed from the back jacquard bars JB6 and JB7.

Further, at a plurality of positions in the front portion 21 and the instep portion 22, the hole texture in FIG. 3C is formed by the front jacquard bars JB3 and JB4, and the hole texture in FIG. 4C is formed by the back jacquard bars JB6 and JB7. Accordingly, a plurality of holes 30 are formed. These holes 30 become vent holes for shoes. In the hole texture in FIG. 3C, since the front jacquard bars JB3 and JB4 also overlap the front-side row of knitting needles FN, an orange-color yarn is also seen at the opening end of the hole 30 on the front-side surface of the front portion 21 and the instep portion 22.

In the front portion 21 and the instep portion 22, since the front-side base fabric 1 is joined to the back-side base fabric 2, the insertion yarns inserted by the guide bar GB5 are compressed by being pressed from the front side and the back side. Thus, the front portion 21 and the instep portion 22 do not bulge.

In the top portion 24, a portion composed of the knit textures in FIG. 3D and FIG. 4D and a portion composed of knit textures in FIG. 3E and FIG. 4E are arranged to forma checkered pattern. Thus, the front-side surface of the top portion 24 has a white color which is a color of yarns fed from the back jacquard bars JB6 and JB7. Meanwhile, in a portion composed of knit textures in FIG. 3E and FIG. 4E, a slightly orange-colored yarn is also seen from the front-side surface. This is because the knit textures in FIG. 3E and FIG. 4E forma relatively thin cloth, and also the orange color is an outstanding color. Since in any combination of the knit textures, the front-side base fabric 1 is joined to the back-side base fabric 2, in the top portion 24 formed by these knit textures, the insertion yarns inserted by the guide bar GB5 are compressed by being pressed. Thus, the top portion 24 does not bulge.

At a plurality of predetermined positions of the top portion 24, the hole texture in FIG. 3C is formed by the front jacquard bars JB3 and JB4, and the hole texture in FIG. 4C is formed by the back jacquard bars JB6 and JB7. Accordingly, holes 31 are formed at a plurality of predetermined positions of the top portion 24. These holes 31 become holes through which a shoelace passes. As in the hole 30 as described above, an orange-color yarn is seen at the opening end of the hole 31 at the front-side of the top portion 24.

In the side portion 23, first linear portions 36 composed of the knit textures in FIG. 3D and FIG. 4D, and second linear portions 37 composed of the knit textures in FIG. 3A and FIG. 4A form oblique straight lines, respectively, and are alternately arranged. In the first linear portions 36 composed of the knit textures in FIG. 3D and FIG. 4D, and the second linear portions 37 composed of the knit textures in FIG. 3D and FIG. 4D, colors are reversed, and thus a striped pattern of an orange color and a white color is formed on the side portion 23. On the front-side surface, the first linear portions 36 composed of the knit textures in FIG. 3D and FIG. 4D are white, and the second linear portions 37 composed of the knit textures in FIG. 3A and FIG. 4A are orange-colored.

In the side portion 23, since in the knit textures in FIG. 3D and FIG. 4D, the front-side base fabric 1 is joined to the back-side base fabric 2, the first linear portion 36 composed of the knit textures does not bulge. Meanwhile, in the knit textures in FIG. 3A and FIG. 4A, the front-side base fabric 1 is not joined to the back-side base fabric 2, and thus the second linear portion 37 composed of the knit textures bulges. As a result, irregularities conforming to the striped pattern are formed on the side portion 23.

In the rear portion 25, the thick cloth texture in FIG. 3A is formed by the front jacquard bars JB3 and JB4, and the thin cloth texture in FIG. 4B is formed by the back jacquard bars JB6 and JB7. Therefore, the front-side surface of the rear portion 25 has an orange color which is a color of the yarns fed from the front jacquard bars JB3 and JB4. Since the front-side base fabric 1 is not joined to the back-side base fabric 2, the rear portion 25 bulges to become a convex portion.

At a plurality of predetermined positions in the rear portion 25, the hole texture in FIG. 3C is formed by the front jacquard bars JB3 and JB4, and the hole texture in FIG. 4C is formed by the back jacquard bars JB6 and JB7. Accordingly, holes 32 are formed at a plurality of predetermined positions in the rear portion 25. The front-side base fabric 1 is joined to the back-side base fabric 2 at the opening end of the hole 32. These holes 32 become vent holes for shoes.

In the heel portion 26, the knit texture in FIG. 3D is formed by the front jacquard bars JB3 and JB4, and the knit texture in FIG. 4D is formed by the back jacquard bars JB6 and JB7. In a portion composed of the knit textures in FIG. 3D and FIG. 4D, the front-side surface has a white color which is a color of the yarns fed from the back jacquard bars JB6 and JB7.

In the heel portion 26, quadrangular portions 35 composed of the knit textures in FIG. 3A and FIG. 4B are periodically arranged. In the portion composed of the knit textures in FIG. 3A and FIG. 4B, the front-side surface has an orange color which is a color of yarns fed from the front jacquard bars JB3 and JB4. Accordingly, on the front-side surface of the heel portion 26, a jacquard pattern is formed in which the orange-colored quadrangular portions 35 are periodically arranged on a white background.

In the heel portion 26, in the portion composed of the knit textures in FIG. 3D and FIG. 4D, the front-side base fabric is joined to the back-side base fabric 2, and in the quadrangular portions 35 composed of the knit textures in FIG. 3A and FIG. 4B, the front-side base fabric 1 is not joined to the back-side base fabric 2. Thus, the orange-colored quadrangular portions 35 composed of the knit textures in FIG. 3A and FIG. 4B bulge with respect to surroundings thereof.

At the boundary portion between the above portions, the same knit texture as that of, for example, the toe portion 20 is employed. Accordingly, on the front-side surface of the warp knitted fabric 10, the boundary portion between the above portions becomes a clear bulging boundary line in an orange color.

To summarize the above description, on the front-side surface of the warp knitted fabric 10, the toe portion 20, the second linear portions 37 of the side portion 23, the rear portion 25, the quadrangular portions 35 of the heel portion 26, and the boundary portions between the respective portions become bulging convex portions in an orange color, and the front portion 21, the instep portion 22, the top portion 24, the first linear portions 36 of the side portion 23, and the portions other than the quadrangular portions 35 in the heel portion 26 become non-bulging concave portions in white. In this manner, on the front-side surface of the warp knitted fabric 10, a jacquard pattern and irregularities conforming to the jacquard pattern are formed.

On the back-side surface of the warp knitted fabric 10, between the front jacquard yarns and the back jacquard yarns, yarns which do not appear on the front-side surface mainly appear. Thus, on the back-side surface, a jacquard pattern in which the color is reversed with respect to the front-side surface is formed.

As described above, a jacquard pattern is formed on the front-side base fabric 1 and the back-side base fabric 2 of the warp knitted fabric 10, and further irregularities conforming to the jacquard pattern are formed.

In the peripheral part 12, a portion composed of the knit textures in FIG. 3D and FIG. 4D, and a portion composed of the knit textures in FIG. 3B and FIG. 4B are alternately formed in every predetermined course. Accordingly, the front-side base fabric 1 is joined to the back-side base fabric 2.

(5) Process after Knitting

After the knitting, the warp knitted fabric 10 is heated by a method such as boiling in order to obtain a volume of a convex portion. The heating is performed, for example, at 95° C. to 100° C. for 20 min to 30 min. Thereafter, a finishing processing such as heat-setting is performed on the warp knitted fabric 10 after the knitting. After the finishing processing, in the warp knitted fabric 10, the height of a convex portion (the height from the bottom portion of a concave portion surface to a convex portion vertex) may be 1 mm or more, and further may be 2 mm or more.

In actuality, in the warp knitted fabric 10 knitted by the double raschel machine, a plurality of upper parts 11 are arranged in rows and columns. After the knitting, in a proper process, the plurality of upper parts 11 are separated and collected from one warp knitted fabric 10.

(6) Effect

In the warp knitting machine of the first embodiment, the guide bar GB5 is provided between the front jacquard bars JB3 and JB4 and the back jacquard bars JB6 and JB7. Therefore, insertion yarns may be inserted between the front-side base fabric 1 and the back-side base fabric 2.

During the knitting of the warp knitted fabric 10, the front jacquard bars JB3 and JB4 and the back jacquard bars JB6 and JB7 forma jacquard pattern on the surface of the front-side base fabric 1 (that is, the front-side surface of the warp knitted fabric 10) and the surface of the back-side base fabric 2 (that is, the back-side surface of the warp knitted fabric 10) using jacquard yarns, while joining the front-side base fabric 1 to the back-side base fabric 2. Here, the insertion yarns inserted between the front-side base fabric 1 and the back-side base fabric 2 are compressed by being pressed from the front side and the back side at the joining position of the front-side base fabric 1 and the back-side base fabric 2, and are not pressed and not compressed at the non-joining position of the front-side base fabric 1 and the back-side base fabric 2.

As a result of the knitting through such a method, the warp knitted fabric 10 does not bulge at the joining position of the front-side base fabric 1 and the back-side base fabric 2, but bulges at the non-joining position. In this manner, irregularities matching the pattern are formed on the warp knitted fabric 10.

Here, the front-side guide bar GB2 and the back-side guide bar GB8 knit chain stitch textures, respectively, and the front jacquard bars JB3 and JB4 and the back jacquard bars JB6 and JB7 form a joining position where adjacent wales of the chain stitch texture are joined using jacquard yarns, and a non-joining position where adjacent wales are not joined. Then, when the non-joining position of the adjacent wales of the chain stitch texture at the front side coincides with the non-joining position of the adjacent wales of the chain stitch texture at the back side in the front-back direction (the front-back direction of the warp knitted fabric 10), the holes 30, 31, and 32 are formed in the warp knitted fabric 10. Thus, holes in the warp knitted fabric 10, such as vent holes or holes for a shoelace in a shoe upper, may be easily formed.

The warp knitted fabric 10 manufactured as described above and a shoe upper including the warp knitted fabric 10 may be easily manufactured, and are excellent in a design property because irregularities are formed according to a pattern.

2. Second Embodiment

A structure of a warp knitting machine in the second embodiment and a basic method of manufacturing a warp knitted fabric are the same as those in the first embodiment.

(1) Specific Knitting Example 2

Knit texture views of the knitting example of the second embodiment are illustrated in FIGS. 7A-7F. In the knitting example of the second embodiment as well, the guide bars GB2, GB5, GB8, and GB9, and the jacquard bars JB3, JB4, JB6, and JB7 are used for knitting.

In the knitting, to each of the guide bars GB2, GB5, GB8, and GB9, yarns are fed to form a full set. To the front jacquard bars JB3 and JB4 and the back jacquard bars JB6 and JB7 as well, yarns are fed to form full sets, respectively.

Figures 7A, 7B, 7C, 7D, 7E, 7F:
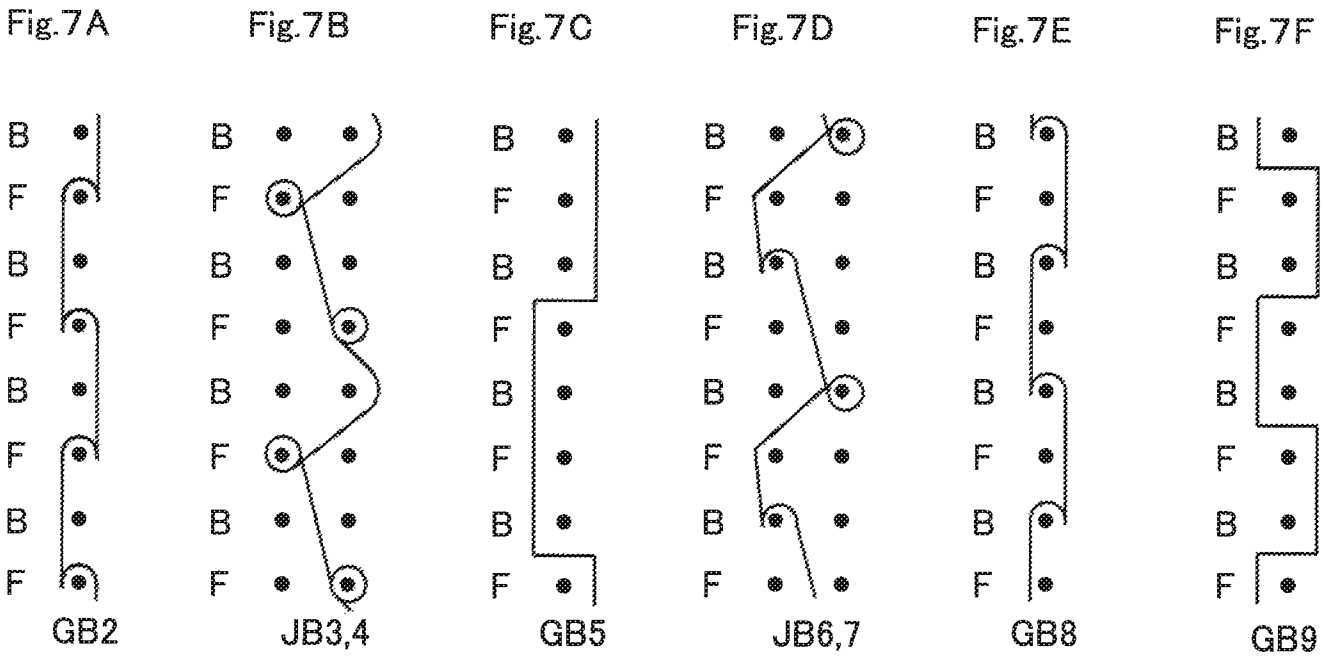

As illustrated in FIG. 7A, the knit texture of the guide bar GB2 is a chain stitch texture in which stitches are formed in the same wale, and is composed of repetition units of 0-1/1-1/1-0/0-0//. The knit texture of the guide bar GB5 as illustrated in FIG. 7C is an insertion texture, and is composed of repetition units of 0-0/1-1/1-1/1-1/1-1/0-0/0-0/0-0//. The knit texture of the guide bar GB8 as illustrated in FIG. 7E is a chain stitch texture and is composed of repetition units of 1-1/1-0/0-0/0-1//. The knit texture of the guide bar GB9 as illustrated in FIG. 7F is an insertion texture, and is composed of repetition units of 1-1/0-0/0-0/1-1//.

In this manner, stitches are formed in all wales and courses of the front-side base fabric 1 and the back-side base fabric 2 using the guide bar GB2 and the guide bar GB8. Here, since the knit textures formed by the guide bar GB2 and the guide bar GB8 are chain stitch textures, adjacent wales are not joined without jacquard yarns. As described below, the jacquard yarns join the adjacent wales.

The insertion yarns inserted by the guide bar GB5 serve a role of swelling the warp knitted fabric as described below. The insertion yarns inserted by the guide bar GB9 serve a role of reinforcing the warp knitted fabric.

FIGS. 7B and 7D illustrate basic textures formed by the jacquard bars JB3, JB4, JB6, and JB7, that is, knit textures formed by the jacquard bars JB3, JB4, JB6, and JB7 when the jacquard mechanism does not work. The basic texture formed by the front jacquard bars JB3 and JB4 as illustrated in FIG. 7B is composed of repetition units of 1-0/1-1/1-2/0-0//. The basic texture formed by the back jacquard bars JB6 and JB7 as illustrated in FIG. 7D is composed of repetition units of 1-1/1-2/2-2/1-0//.

In FIG. 8, the above described basic texture formed by the front jacquard bars JB3 and JB4 is indicated by a broken line, and an example of a knit texture formed by the front jacquard bars JB3 and JB4 is indicated by a solid line when the jacquard mechanism acts.

Figure 8C:
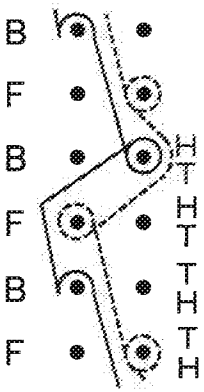
Figure 8B:
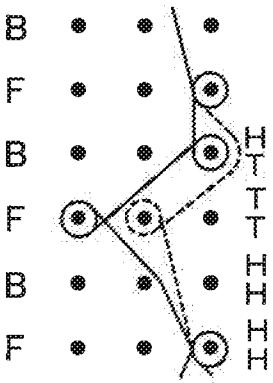
Figure 8A:
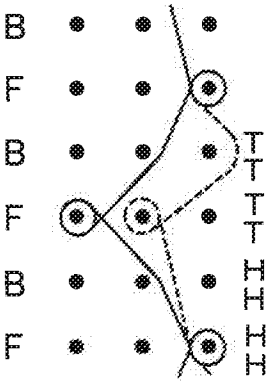

In FIG. 8A, an example of a knit texture is illustrated in which the front jacquard bars JB3 and JB4 overlap the front-side row of knitting needles FN due to the action of the jacquard mechanism. The knit texture in FIG. 8A is one called a front thick cloth texture, and is composed of repetition units of 1-0/1-1/2-3/1-1//. In this manner, the front jacquard bars JB3 and JB4 overlap the front-side row of knitting needles FN so that the front-side base fabric 1 is formed by the front jacquard yarns and yarns fed from the guide bar GB2. The front jacquard yarns appear on the surface (the front-side surface) of the front-side base fabric 1.

Here, the front jacquard yarns reciprocate between three needles in the wale direction in one repetition unit while forming a needle loop. Therefore, the front jacquard yarns join different wales of the chain stitch texture formed by the yarns fed from the guide bar GB2.

In FIG. 8B, an example of a knit texture is illustrated in which the front jacquard bars JB3 and JB4 overlap both the front-side row of knitting needles FN and the back-side row of knitting needles BN due to the action of the jacquard mechanism. The knit texture in FIG. 8B is composed of repetition units of 1-0/1-1/2-3/1-0//. Accordingly, overlapping with respect to the front-side row of knitting needles FN is performed twice every time overlapping with respect to the back-side row of knitting needles BN is performed once. In this manner, the front jacquard bars JB3 and JB4 overlap both the front-side row of knitting needles FN and the back-side row of knitting needles BN so that the front-side base fabric 1 is joined to the back-side base fabric 2.

Here, the front jacquard yarns reciprocate between three needles in the wale direction in one repetition unit while forming a needle loop. Therefore, the front jacquard yarns join different wales in the chain stitch texture formed by the yarns fed from the guide bar GB2 and the chain stitch texture formed by the yarns fed from the guide bar GB8.

In FIG. 8C, an example of a knit texture is illustrated in which the front jacquard bars JB3 and JB4 overlap the back-side row of knitting needles BN due to the action of the jacquard mechanism. The knit texture in FIG. 8C is one called a back thin cloth texture, and is composed of repetition units of 1-1/1-2/2-2/1-0//. In this manner, the front jacquard bars JB3 and JB4 overlap the back-side row of knitting needles BN so that the front jacquard yarns are knitted into the back-side base fabric 2. Here, the front jacquard yarns appear on the surface (the back-side surface) of the back-side base fabric 2.

Here, the front jacquard yarns reciprocate between two needles in the wale direction in one repetition unit while forming a needle loop. Therefore, the front jacquard yarns join different wales of the chain stitch texture formed by the yarns fed from the guide bar GB8.

Figure 8E:
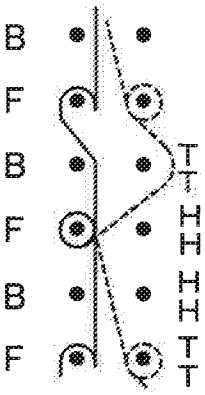
Figure 8D:
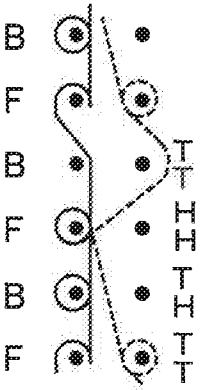

In FIG. 8D, an example of a knit texture is illustrated in which the front jacquard bars JB3 and JB4 wrap only within the same wale due to the action of the jacquard mechanism. The knit texture in FIG. 8D is one called a hole texture, and is composed of repetition units of 1-0/0-1/0-1/0-0//. In this case, the front jacquard yarns do not join adjacent wales of the chain stitch texture formed by the yarns fed from the guide bars GB2 and GB8.

In the knit texture in FIG. 8D, the front jacquard bars JB3 and JB4 overlap the front-side row of knitting needles FN and the back-side row of knitting needles BN, and the front jacquard yarns are knitted into the front-side base fabric 1 and the back-side base fabric 2. Thus, the front-side base fabric 1 is joined to the back-side base fabric 2.

In FIG. 8E, an example of a knit texture is illustrated in which the front jacquard bars JB3 and JB4 wraps only within the same wale due to the action of the jacquard mechanism. The knit texture in FIG. 8E is one called a hole texture, and is composed of repetition units of 1-0/0-0/0-1/0-0//. In this case, the front jacquard yarns do not join adjacent wales of the chain stitch texture formed by the yarns fed from the guide bars GB2 and GB8. The front jacquard bars JB3 and JB4 overlap only the front-side row of knitting needles FN, and thus the front jacquard yarns do not join the front-side base fabric 1 to the back-side base fabric 2.

In FIG. 9, the above described basic texture formed by the back jacquard bars JB6 and JB7 is indicated by a broken line, and an example of a knit texture formed by the back jacquard bars JB6 and JB7 is indicated by a solid line when the jacquard mechanism acts.

Figure 9C:
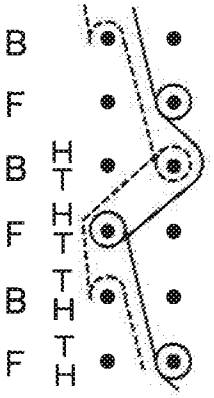
Figure 9B:
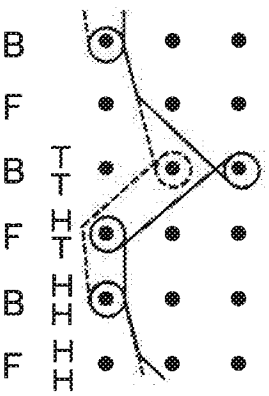
Figure 9A:
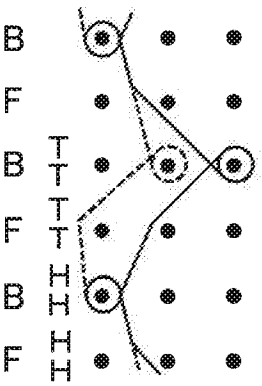

In FIG. 9A, an example of a knit texture is illustrated in which the back jacquard bars JB6 and JB7 overlap the back-side row of knitting needles BN due to the action of the jacquard mechanism. The knit texture in FIG. 9A is one called a back thick cloth texture, and is composed of repetition units of 2-2/2-3/2-2/1-0//. In this manner, the back jacquard bars JB6 and JB7 overlap the back-side row of knitting needles BN so that the back-side base fabric 2 is formed by the back jacquard yarns and the yarns fed from the guide bar GB8 and GB9. Here, the back jacquard yarns appear on the surface (the back-side surface) of the back-side base fabric 2.

Here, the back jacquard yarns reciprocate between three needles in the wale direction in one repetition unit while forming a needle loop. Therefore, the back jacquard yarns join different wales of the chain stitch texture formed by the yarns fed from the guide bar GB8.

In FIG. 9B, an example of a knit texture is illustrated in which the back jacquard bars JB6 and JB7 overlap both the front-side row of knitting needles FN and the back-side row of knitting needles BN due to the action of the jacquard mechanism. The knit texture in FIG. 9B is composed of repetition units of 2-2/2-3/2-3/1-0//. Therefore, overlapping with respect to the back-side row of knitting needles BN is performed twice every time overlapping with respect to the front-side row of knitting needles FN is performed once. In this manner, the back jacquard bars JB6 and JB7 overlap both the front-side row of knitting needles FN and the back-side row of knitting needles BN so that the front-side base fabric 1 is joined to the back-side base fabric 2.

Here, the back jacquard yarns reciprocate between three needles in the wale direction in one repetition unit while forming a needle loop. Therefore, the back jacquard yarns join different wales in the chain stitch texture formed by the yarns fed from the guide bar GB2 and the chain stitch texture formed by the yarns fed from the guide bar GB8.

In FIG. 9C, an example of a knit texture is illustrated in which the back jacquard bars JB6 and JB7 overlap the front-side row of knitting needles FN due to the action of the jacquard mechanism. The knit texture in FIG. 9C is one called a front thin cloth texture, and is composed of repetition units of 1-0/1-1/1-2/0-0//. In this manner, the back jacquard bars JB6 and JB7 overlap the front-side row of knitting needles FN so that the back jacquard yarns are knitted into the front-side base fabric 1. The back jacquard yarns appear on the surface (the front-side surface) of the front-side base fabric 1.

Here, the back jacquard yarns reciprocate between two needles in the wale direction in one repetition unit while forming a needle loop. Therefore, the back jacquard yarns join different wales of the chain stitch texture formed by the yarns fed from the guide bar GB2.

Figure 9E:
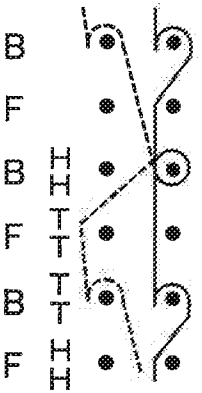
Figure 9D:
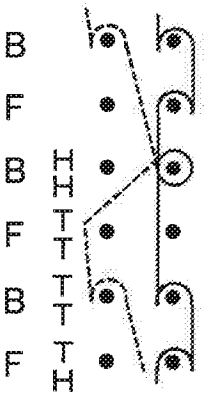

In FIG. 9D, an example of a knit texture is illustrated in which the back jacquard bars JB6 and JB7 warp only within the same wale due to the action of the jacquard mechanism. The knit texture in FIG. 9D is one called a hole texture, and is composed of repetition units of 1-0/0-1/1-1/1-0//. In this case, the back jacquard yarns do not join adjacent wales of the chain stitch texture formed by the yarns fed from the guide bars GB2 and GB8. In the knit texture in FIG. 9D, the back jacquard bars JB6 and JB7 overlap the front-side row of knitting needles FN and the back-side row of knitting needles BN, and the back jacquard yarns are knitted into the front-side base fabric 1 and the back-side base fabric 2. Thus, the front-side base fabric 1 is joined to the back-side base fabric 2.

In FIG. 9E, an example of a knit texture is illustrated in which the back jacquard bars JB6 and JB7 warp only within the same wale due to the action of the jacquard mechanism. The knit texture in FIG. 9E is one called a hole texture, and is composed of repetition units of 1-1/0-1/1-1/1-0//. In this case, the back jacquard yarns do not join adjacent wales of the chain stitch texture formed by the yarns fed from the guide bars GB2 and GB8. The back jacquard bars JB6 and JB7 overlap only the back-side row of knitting needles BN, and thus the back jacquard yarns do not join the front-side base fabric 1 to the back-side base fabric 2.

In the second embodiment, one of knit textures in FIGS. 8A to 8E is selected as a knit texture formed by the front jacquard bars JB3 and JB4 at each knitting position. At the same time, one of knit textures in FIGS. 9A to 9E is selected as a knit texture formed by the back jacquard bars JB6 and JB7 at each knitting position. In this manner, at each knitting position, a combination of the knit texture formed by the front jacquard bars JB3 and JB4 and the knit texture formed by the back jacquard bars JB6 and JB7 is realized.

Depending on the combination, a hole may be formed in the warp knitted fabric, or a specific yarn may be caused to appear on the front-side or back-side surface of the warp knitted fabric. Then, by changing a combination for each knitting position, a jacquard pattern may be formed on the front-side or back-side surface of the warp knitted fabric. Irregularities matching the jacquard pattern may be formed.

For example, as a knit texture formed by the front jacquard bars JB3 and JB4 at a certain position, the front thick cloth texture as illustrated in FIG. 8A is selected, and as a knit texture formed by the back jacquard bars JB6 and JB7 at the same position, the back thick cloth texture as illustrated in FIG. 9A is selected. In this case, the front jacquard yarns appear on the front-side surface of the warp knitted fabric, and the back jacquard yarns appear on the back-side surface. In this case, the front-side base fabric 1 is not joined to the back-side base fabric 2.

As a knit texture formed by the front jacquard bars JB3 and JB4 at another position, the back thin cloth texture as illustrated in FIG. 8C is selected, and as a knit texture formed by the back jacquard bars JB6 and JB7 at the same position, the front thin cloth texture as illustrated in FIG. 9C is selected. In this case, the back jacquard yarns appear on the front-side surface of the warp knitted fabric, and the front jacquard yarns appear on the back-side surface. In this case, sinker loops of the front jacquard yarns and sinker loops of the back jacquard yarns do not directly intersect. However, both the sinker loops of the front jacquard yarns and the sinker loops of the back jacquard yarns get entangled with the insertion yarns inserted by the guide bar GB5. Therefore, the front-side base fabric 1 and the back-side base fabric 2 are joined to each other while mutually attracting each other.

As a knit texture formed by the front jacquard bars JB3 and JB4 at another position, the knit texture in FIG. 8B is selected and, and as a knit texture formed by the back jacquard bars JB6 and JB7 at the same position, a knit texture in FIG. 9B is selected. In this case, all jacquard bars JB3, JB4, JB6, and JB7 overlap both the front-side row of knitting needles FN and the back-side row of knitting needles BN so that the front-side base fabric 1 is joined to the back-side base fabric 2. Meanwhile, the extent of wrapping of the front jacquard bars JB3 and JB4 with respect to the front-side row of knitting needles FN is larger than that of the back jacquard bars JB6 and JB7. Thus, in this case, on the front-side surface of the warp knitted fabric, the front jacquard yarns mainly appear.

In this manner, on the front-side surface of the warp knitted fabric, a portion in which the front jacquard yarns appear and a portion in which the back jacquard yarns appear are formed. Then, when different types of yarns are fed to the front jacquard bars JB3 and JB4 and the back jacquard bars JB6 and JB7, a jacquard pattern is formed on the front-side surface of the warp knitted fabric.

Similarly, on the back-side surface of the warp knitted fabric, a portion in which the front jacquard yarns appear and a portion in which the back jacquard yarns appear are formed. Then, when different types of yarns are fed to the front jacquard bars JB3 and JB4 and the back jacquard bars JB6 and JB7, a jacquard pattern is formed on the back-side surface of the warp knitted fabric.

Meanwhile, the insertion yarns inserted by the guide bar GB5 are inserted between the front-side base fabric 1 and the back-side base fabric 2. The insertion yarns are compressed at the joining position where the front-side base fabric 1 is joined to the back-side base fabric 2, and are not compressed at the non-joining position where the front-side base fabric 1 is not joined to the back-side base fabric 2. Thus, in the same manner as in first embodiment, irregularities conforming to the jacquard pattern are formed in the warp knitted fabric.

In the case of the second embodiment, on the front-side surface of the warp knitted fabric, a convex portion composed of a combination of the knit textures in FIG. 8A and FIG. 9A, in which the front jacquard yarns appear, a concave portion composed of a combination of the knit textures in FIG. 8C and FIG. 9C, in which the back jacquard yarns appear, and a concave portion composed of a combination of the knit textures in FIG. 8B and FIG. 9B, in which the front jacquard yarns appear, are formed. The concave portion is a portion composed of the joining position of the front-side base fabric 1 and the back-side base fabric 2.

At a bulging portion where the front-side base fabric 1 is not joined to the back-side base fabric 2, when sinker loops of jacquard yarns in any one of the front-side base fabric 1 and the back-side base fabric 2 is longer than sinker loops of jacquard yarns in the other base fabric, the warp knitted fabric bulges more largely at the base fabric side with the longer sinker loops. This is also the same as that in the first embodiment.

As a knit texture formed by the front jacquard bars JB3 and JB4 at a certain position, the hole texture in FIG. 8D or 8E is selected, and as a knit texture formed by the back jacquard bars JB6 and JB7 at the same position, the hole texture in FIG. 9D or 9E is selected. Therefore, at the corresponding position, adjacent wales are not joined in the front-side base fabric 1 and the back-side base fabric 2, and a hole is formed at the corresponding position in the warp knitted fabric. Here, when the hole texture in FIG. 8D is selected as the knit texture formed by the front jacquard bars JB3 and JB4, or the hole texture in FIG. 9D is selected as the knit texture formed by the back jacquard bars JB6 and JB7, the front-side base fabric 1 is joined to the back-side base fabric 2 at the opening end of the hole in the warp knitted fabric.

(2) Specific Example of Warp Knitted Fabric 110

Figure 10:
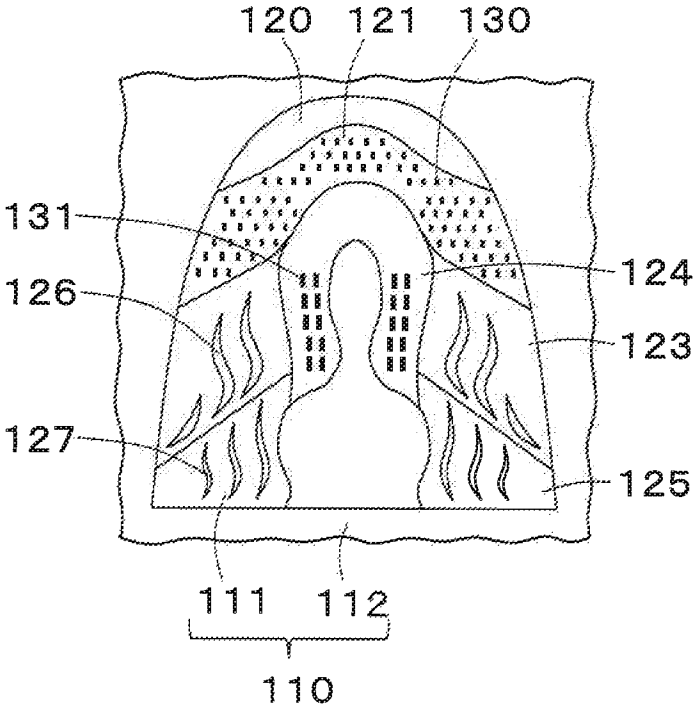
FIG. 10 is a view illustrating a front-side surface of a warp knitted fabric 110 knitted in the second embodiment.

The front-side surface of the warp knitted fabric 110 knitted in the knitting example 2 is illustrated in FIG. 10. The warp knitted fabric 110 is formed by integrally knitting an upper part 111 and a peripheral part 112 thereof used for a shoe upper. The upper part 111 includes a pattern composed of a toe portion 120, a front portion 121, a side portion 123, a top portion 124, and a rear portion 125.

In the knitting of the warp knitted fabric 110 as described below, it is assumed that light grey yarns are fed to the guide bar GB2 and the front jacquard bars JB3 and JB4, and dark grey yarns are fed to the guide bars GB5, GB8, and GB9 and the back jacquard bars JB6 and JB7.

In the upper part 111 and the peripheral part 112, the knit textures in FIG. 7 are formed by the guide bars GB2, GB5, GB8, and GB9. The knit textures to be described below are formed by the front jacquard bars JB3 and JB4 and the back jacquard bars JB6 and JB7.

In the toe portion 120, the front thick cloth texture in FIG. 8A is formed by the front jacquard bars JB3 and JB4, and the back thick cloth texture in FIG. 9A is formed by the back jacquard bars JB6 and JB7. Therefore, the front-side surface of the toe portion 120 has a light grey color which is a color of the yarns fed from the front jacquard bars JB3 and JB4. Since the front-side base fabric 1 is not joined to the back-side base fabric 2, the toe portion 120 bulges to become a convex portion.

In the front portion 121, the knit texture in FIG. 8B is formed by the front jacquard bars JB3 and JB4, and the knit texture in FIG. 9B is formed by the back jacquard bars JB6 and JB7. Therefore, the front-side surface of the front portion 121 has a light grey color close to the color of the yarns fed from the front jacquard bars JB3 and JB4. In the front portion 121, since the front-side base fabric 1 is joined to the back-side base fabric 2, the insertion yarns inserted by the guide bar GB5 are compressed by being pressed from the front side and the back side. Thus, the front portion 121 does not bulge.

Further, at a plurality of positions in the front portion 121, the hole texture in FIG. 8D is formed by the front jacquard bars JB3 and JB4, and the hole texture in FIG. 9D is formed by the back jacquard bars JB6 and JB7. Accordingly, a plurality of holes 130 are formed. These holes 130 become vent holes for shoes.

In the top portion 124, the knit texture in FIG. 8B is formed by the front jacquard bars JB3 and JB4, and the knit texture in FIG. 9B is formed by the back jacquard bars JB6 and JB7. Therefore, the front-side surface of the top portion 124 has a light grey color close to the color of the yarns fed from the front jacquard bars JB3 and JB4. In the top portion 124, since the front-side base fabric 1 is joined to the back-side base fabric 2, the insertion yarns inserted by the guide bar GB5 are compressed by being pressed from the front side and the back side. Thus, the top portion 124 does not bulge.

Further, at a plurality of positions in the top portion 124, the hole texture in FIG. 8D is formed by the front jacquard bars JB3 and JB4, and the hole texture in FIG. 9D is formed by the back jacquard bars JB6 and JB7. Accordingly, a plurality of holes 131 are formed. These holes 131 become holes through which a shoelace passes in shoes.

In the side portion 123, the back thin cloth texture in FIG. 8C is formed by the front jacquard bars JB3 and JB4, and the front thin cloth texture in FIG. 9C is formed by the back jacquard bars JB6 and JB7. Therefore, the front-side surface of the side portion 123 has a dark grey color which is a color of the yarns fed from the back jacquard bars JB6 and JB7. In the side portion 123, since the front-side base fabric 1 is joined to the back-side base fabric 2, the insertion yarns inserted by the guide bar GB5 are compressed by being pressed from the front side and the back side. Thus, the side portion 123 does not bulge.

Further, wavy pattern portions 126 are formed in the side portion 123. In the pattern portion 126, the front thick cloth texture in FIG. 8A is formed by the front jacquard bars JB3 and JB4, and the back thick cloth texture in FIG. 9A is formed by the back jacquard bars JB6 and JB7. Thus, the front-side surface of the pattern portion 126 has a light grey which is a color of the yarns fed from the front jacquard bars JB3 and JB4. Since the front-side base fabric 1 is not joined to the back-side base fabric 2, the pattern portion 126 bulges to become a convex portion.

In the rear portion 125, the knit texture in FIG. 8B is formed by the front jacquard bars JB3 and JB4, and the knit texture in FIG. 9B is formed by the back jacquard bars JB6 and JB7. Therefore, the front-side surface of the rear portion 125 has a light grey close to the color of the yarns fed from the front jacquard bars JB3 and JB4. In the rear portion 125, since the front-side base fabric 1 is joined to the back-side base fabric 2, the insertion yarns inserted by the guide bar GB5 are compressed by being pressed from the front side and the back side. Thus, the rear portion 125 does not bulge.

Further, wavy pattern portions 127 are formed in the rear portion 125. In the pattern portion 127, the front thick cloth texture in FIG. 8A is formed by the front jacquard bars JB3 and JB4, and the back thick cloth texture in FIG. 9A is formed by the back jacquard bars JB6 and JB7. Therefore, the front-side surface of the pattern portion 127 has a light grey color which is a color of the yarns fed from the front jacquard bars JB3 and JB4. Since the front-side base fabric 1 is not joined to the back-side base fabric 2, the pattern portion 127 bulges to become a convex portion.

At the boundary portion between the above portions, the same knit texture as that of, for example, the toe portion 120 is employed. Accordingly, on the front-side surface of the warp knitted fabric 110, the boundary portion between the above portions becomes a clear bulging boundary line in a light grey color.

To summarize the above description, on the front-side surface of the warp knitted fabric 110, the toe portion 120, the pattern portions 126 of the side portion 123, the pattern portions 127 of the rear portion 125, and the boundary portions between the respective portions become bulging convex portions in light grey, the front portion 121, the top portion 124, and the rear portion 125 become non-bulging concave portions in light grey, and the side portion 123 becomes a non-bulging concave portion in dark grey. In this manner, on the front-side surface of the warp knitted fabric 110, a jacquard pattern and irregularities conforming to the jacquard pattern are formed.

On the back-side surface of the warp knitted fabric 110, between the yarns fed from the front jacquard bars JB3 and JB4 and the yarns fed from the back jacquard bars JB6 and JB7, the yarns which do not appear on the front-side surface mainly appear. Thus, on the back-side surface, a jacquard pattern in which the color is reversed with respect to the front-side surface is formed.

As described above, a jacquard pattern is formed on the front-side base fabric 1 and the back-side base fabric 2 of the warp knitted fabric 110, and further irregularities conforming to the jacquard pattern are formed.

In the peripheral part 112, for example, the knit texture in FIG. 8B is formed by the front jacquard bars JB3 and JB4, and the knit texture in FIG. 9B is formed by the back jacquard bars JB6 and JB7. Thus, the front-side base fabric 1 is joined to the back-side base fabric 2.

In actuality, in the warp knitted fabric 110 knitted by the double raschel machine, a plurality of shoe upper-shaped portions are arranged in rows and columns. After the knitting, in a proper process, the plurality of upper parts 111 are separated and collected from one warp knitted fabric 110.

(3) Effect

According to the second embodiment, similarly to the first embodiment, irregularities conforming to a pattern of the warp knitted fabric 110 may be formed and further holes may be formed.

3. Third Embodiment

A structure of a warp knitting machine in the third embodiment and a basic method of manufacturing a warp knitted fabric are the same as those in the first embodiment.

(1) Specific Knitting Example 3

A knit texture view of the knitting example of the third embodiment is illustrated in FIG. 11. In the knitting example of the third embodiment as well, the guide bars GB2, GB5, GB8, and GB9, the front jacquard bars JB3 and JB4 and the back jacquard bars JB6 and JB7 are used for knitting.

In the knitting, to each of the guide bars GB2, GB5, GB8, and GB9, yarns are fed to form a full set. To the front jacquard bars JB3 and JB4 and the back jacquard bars JB6 and JB7 as well, yarns are fed to form full sets, respectively.

Figures 11A, 11B, 11C, 11D, 11E, 11F:
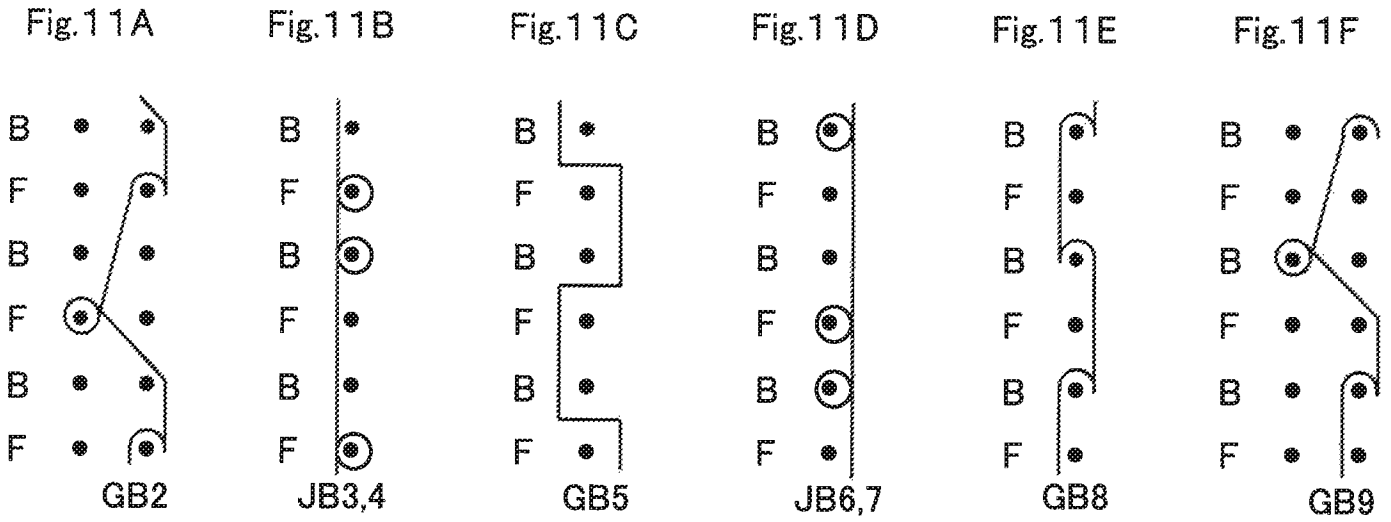
FIG. 11A is a knit texture formed by the guide bar GB2.
FIG. 11B is a basic texture formed by the front jacquard bars JB3 and JB4.
FIG. 11C is a knit texture formed by the guide bar GB5.
FIG. 11D is a basic texture formed by the back jacquard bars JB6 and JB7.
FIG. 11E is a knit texture formed by the guide bar GB8.
FIG. 11F is a knit texture formed by the guide bar GB9.

As illustrated in FIG. 11A, the knit texture of the guide bar GB2 is composed of repetition units of 1-0/0-0/1-2/1-1//, and forms a Denbigh texture on the front-side base fabric 1. The knit texture of the guide bar GB5 as illustrated in FIG. 11C is an insertion texture and is composed of repetition units of 0-0/1-1/1-1/0-0//. The knit texture of the guide bar GB8 as illustrated in FIG. 11E is a chain stitch texture, and is composed of repetition units of 1-1/1-0/0-0/0-1//. The knit texture of the guide bar GB9 as illustrated in FIG. 11F is composed of repetition units of 1-1/1-0/0-0/1-2//, and forms a Denbigh texture on the back-side base fabric 2.

In this manner, stitches are formed in all wales and courses of the front-side base fabric 1 and the back-side base fabric 2 using the guide bar GB2 and the guide bars GB8 and GB9. The insertion yarns inserted by the guide bar GB5 serve a role of swelling the warp knitted fabric.

FIG. 11 also illustrates basic textures formed by the jacquard bars JB3, JB4, JB6, and JB7, that is, knit textures formed by the jacquard bars JB3, JB4, JB6, and JB7 when the jacquard mechanism does not work. The basic texture formed by the front jacquard bars JB3 and JB4 as illustrated in FIG. 11B is composed of repetition units of 1-0/1-1/1-1/1-0//. The basic texture formed by the back jacquard bars JB6 and JB7 as illustrated in FIG. 11D is composed of repetition units of 0-0/0-1/0-1/0-0//.

In FIG. 12, the above basic texture formed by the front jacquard bars JB3 and JB4 is indicated by a broken line, and an example of a knit texture formed by the front jacquard bars JB3 and JB4 is indicated by a solid line when the jacquard mechanism acts.

Figure 12C:
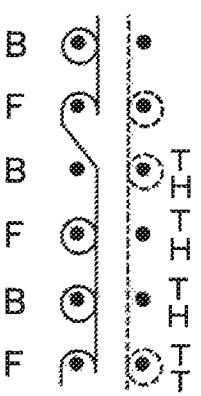
Figure 12B:
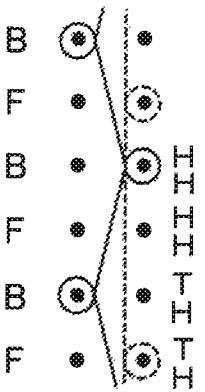
Figure 12A:
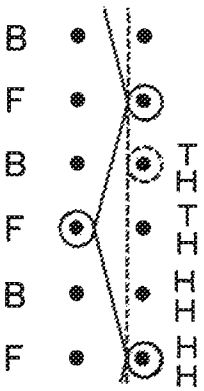

In FIG. 12A, an example of a knit texture is illustrated in which the front jacquard bars JB3 and JB4 overlap the front-side row of knitting needles FN due to the action of the jacquard mechanism. The knit texture in FIG. 12A is composed of repetition units of 1-0/1-1/1-2/1-1//. In this manner, the front jacquard bars JB3 and JB4 overlap the front-side row of knitting needles FN so that the front-side base fabric 1 is formed by the front jacquard yarns and yarns fed from the guide bar GB2. The front jacquard yarns appear on the surface (the front-side surface) of the front-side base fabric 1.

In FIG. 12B, an example of a knit texture is illustrated in which the front jacquard bars JB3 and JB4 overlap the back-side row of knitting needles BN due to the action of the jacquard mechanism. The knit texture in FIG. 12B is composed of repetition units of 1-1/1-2/1-1/1-0//. In this manner, the front jacquard bars JB3 and JB4 overlap the back-side row of knitting needles BN so that the front jacquard yarns are knitted into the back-side base fabric 2. The front jacquard yarns appear on the surface (the back-side surface) of the back-side base fabric 2.

In FIG. 12C, an example of a knit texture is illustrated in which the front jacquard bars JB3 and JB4 wrap only within the same wale due to the action of the jacquard mechanism. The knit texture in 12C is one called a hole texture, and is composed of repetition units of 1-0/0-1/0-1/0-0//. In the knit texture in 12C, the front jacquard bars JB3 and JB4 overlap the front-side row of knitting needles FN and the back-side row of knitting needles BN, and the front jacquard yarns are knitted into the front-side base fabric 1 and the back-side base fabric 2. Thus, the front-side base fabric 1 is joined to the back-side base fabric 2.

In FIG. 13, the above described basic texture formed by the back jacquard bars JB6 and JB7 is indicated by a broken line, and an example of a knit texture formed by the back jacquard bars JB6 and JB7 is indicated by a solid line when the jacquard mechanism acts.

Figure 13A:
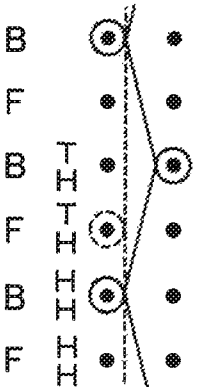

In FIG. 13A, an example of a knit texture is illustrated in which the back jacquard bars JB6 and JB7 overlap the back-side row of knitting needles BN due to the action of the jacquard mechanism. The knit texture in FIG. 13A is composed of repetition units of 1-1/1-2/1-1/1-0//. In this manner, the back jacquard bars JB6 and JB7 overlap the back-side row of knitting needles BN so that the back-side base fabric 2 is formed by the back jacquard yarns and the yarns fed from the guide bars GB8 and GB9. The back jacquard yarns appear on the surface (the back-side surface) of the back-side base fabric 2.

Figure 13B:
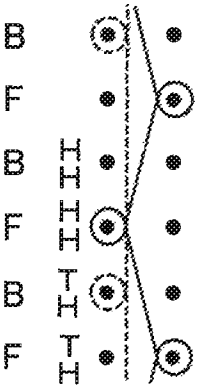

In FIG. 13B, an example of a knit texture is illustrated in which the back jacquard bars JB6 and JB7 overlap the front-side row of knitting needles FN due to the action of the jacquard mechanism. The knit texture in FIG. 13B is composed of repetition units of 1-0/1-1/1-2/1-1//. In this manner, the back jacquard bars JB6 and JB7 overlap the front-side row of knitting needles FN so that the back jacquard yarns are knitted into the front-side base fabric 1. The back jacquard yarns appear on the surface (the front-side surface) of the front-side base fabric 1.

Figure 13C:
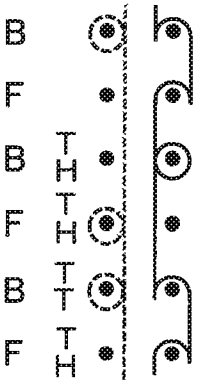

In FIG. 13C, an example of a knit texture is illustrated in which the back jacquard bars JB6 and JB7 warp only within the same wale due to the action of the jacquard mechanism. The knit texture in FIG. 13C is one called a hole texture, and is composed of repetition units of 1-0/0-1/1-1/1-0//. In the knit texture of FIG. 13C, the back jacquard bars JB6 and JB7 overlap the front-side row of knitting needles FN and the back-side row of knitting needles BN, and the back jacquard yarns are knitted into the front-side base fabric 1 and the back-side base fabric 2. Thus, the front-side base fabric 1 is joined to the back-side base fabric 2.

In the third embodiment, one of knit textures in FIGS. 12A-12C is selected as a knit texture formed by the front jacquard bars JB3 and JB4 at each knitting position. At the same time, one of knit textures in FIGS. 13A-13C is selected as a knit texture formed by the back jacquard bars JB6 and JB7 at each knitting position. In this manner, at each knitting position, a combination of the knit texture formed by the front jacquard bars JB3 and JB4 and the knit texture formed by the back jacquard bars JB6 and JB7 is realized.

Depending on the combination, a specific yarn may be caused to appear on the front-side or back-side surface of the warp knitted fabric. Then, by changing a combination for each knitting position, a jacquard pattern may be formed on the front-side or back-side surface of the warp knitted fabric. Irregularities conforming to the jacquard pattern may be formed. Although not illustrated in FIG. 11, a hole may be formed in the warp knitted fabric depending on the combination in the case where the knit texture formed by the guide bars GB2, GB8, and GB9 is a knit texture in which adjacent wales are not joined.

For example, as a knit texture formed by the front jacquard bars JB3 and JB4 at a certain position, the knit texture in the case of overlapping with respect to the front-side row of knitting needles FN as illustrated in FIG. 12A is selected, and as a knit texture formed by the back jacquard bars JB6 and JB7 at the same position, the knit texture in the case of overlapping with respect to the back-side row of knitting needles BN as illustrated in FIG. 13A is selected. In this case, the front jacquard yarns appear on the front-side surface of the warp knitted fabric, and the back jacquard yarns appear on the back-side surface. In this case, the front-side base fabric 1 is not joined to the back-side base fabric 2.

As a knit texture formed by the front jacquard bars JB3 and JB4 at a certain position, the knit texture in the case of overlapping with respect to the back-side row of knitting needles BN as illustrated in FIG. 12B is selected, and as a knit texture formed by the back jacquard bars JB6 and JB7 at the same position, the knit texture in the case of overlapping with respect to the front-side row of knitting needles FN as illustrated in FIG. 13B is selected. In this case, the back jacquard yarns appear on the front-side surface of the warp knitted fabric, and the front jacquard yarns appear on the back-side surface. In this case, overlapping of the front jacquard bars JB3 and JB4 with respect to the back-side row of knitting needles BN and overlapping of the back jacquard bars JB6 and JB7 with respect to the front-side row of knitting needles FN are alternately performed, and sinker loops of the front jacquard yarns and sinker loops of the back jacquard yarns intersect and get entangled with each other. Thus, the front-side base fabric 1 and the back-side base fabric 2 are joined to each other while mutually attracting each other.

In this manner, on the front-side surface of the warp knitted fabric, a portion in which the front jacquard yarns appear and a portion in which the back jacquard yarns appear are formed. Then, when different types of yarns are fed to the front jacquard bars JB3 and JB4 and the back jacquard bars JB6 and JB7, a jacquard pattern is formed on the front-side surface of the warp knitted fabric. Similarly, on the back-side surface of the warp knitted fabric, a portion in which the front jacquard yarns appear and a portion in which the back jacquard yarns appear are formed. Then, when different types of yarns are fed to the front jacquard bars JB3 and JB4 and the back jacquard bars JB6 and JB7, a jacquard pattern is formed on the back-side surface of the warp knitted fabric.

Meanwhile, the insertion yarns inserted by the guide bar GB5 are inserted between the front-side base fabric 1 and the back-side base fabric 2. The insertion yarns are compressed at the joining position where the front-side base fabric 1 is joined to the back-side base fabric 2, and are not compressed at the non-joining position where the front-side base fabric is not joined to the back-side base fabric 2. Thus, irregularities conforming to the jacquard pattern are formed in the warp knitted fabric. This is the same as that in the first embodiment.

In the third embodiment as well, when sinker loops of jacquard yarns in any one of the front-side base fabric 1 and the back-side base fabric 2 is longer than sinker loops of jacquard yarns in the other base fabric, the warp knitted fabric bulges more largely at the base fabric side with the longer sinker loops. This is also the same as that in the first embodiment.

As a knit texture formed by the front jacquard bars JB3 and JB4 at a certain position, the hole texture illustrated in FIG. 12C is selected, and as a knit texture formed by the back jacquard bars JB6 and JB7 at the same position, the hole texture illustrated in FIG. 13C is selected. Then, although not illustrated in FIG. 11, as illustrated in FIGS. 2 and 7, a chain stitch texture is selected as a knit texture of the guide bar GB2, a chain stitch texture is selected as a knit texture of the guide bar GB8, and an insertion texture only within the same wale is selected as a knit texture of the guide bar GB9. In this case, since adjacent wales of the chain stitch texture are not joined at a same position of the front-side base fabric 1 and the back-side base fabric 2, a hole is formed at the corresponding position in the warp knitted fabric.

(2) Specific Example of Warp Knitted Fabric 210

Figure 14:
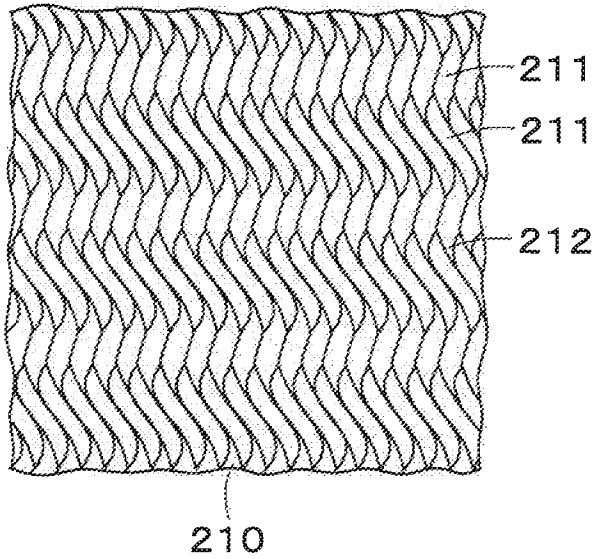
FIG. 14 is a view illustrating a front-side surface of a warp knitted fabric 210 knitted in the third embodiment.

The front-side surface of the warp knitted fabric 210 knitted in the knitting example 3 is illustrated in FIG. 14. The warp knitted fabric 210 may be used as a quilting for use in cold weather clothing, pouches, interior goods or the like. The warp knitted fabric 210 has a pattern including a plurality of graphic portions 211 aligned in the longitudinal direction (the warp direction, the knitting direction) and the lateral direction (the weft direction, the width direction), and line portions 212 that partitioning the graphic portions 211.

In the knitting of the warp knitted fabric 210 as described below, it is assumed that orange yarns are fed to the front jacquard bars JB3 and JB4, and white yarns are fed to the guide bars GB2, GB5, GB8, and GB9 and the back jacquard bars JB6 and JB7 other than the front jacquard bars JB3 and JB4.

In the graphic portions 211 and the line portions 212, the knit textures in FIG. 11 are formed by the guide bars GB2, GB5, GB8, and GB9. The knit textures to be described below are formed by the front jacquard bars JB3 and JB4 and the back jacquard bars JB6 and JB7.

In the graphic portion 211, the knit texture in FIG. 12A is formed by the front jacquard bars JB3 and JB4, and the knit texture in FIG. 13A is formed by the back jacquard bars JB6 and JB7. Therefore, the front-side surface of the graphic portion 211 has an orange color which is a color of the yarns fed from the front jacquard bars JB3 and JB4. Since the front-side base fabric 1 is not joined to the back-side base fabric 2, the insertion yarns inserted by the guide bar GB5 are not compressed. Therefore, the graphic portion 211 bulges to become a convex portion.

In the line portion 212, the knit texture in FIG. 13B is formed by the front jacquard bars JB3 and JB4, and the knit texture in (b) of FIG. 13 is formed by the back jacquard bars JB6 and JB7. Thus, the front-side surface of the line portion 212 has a white color which is a color of the yarns fed from the back jacquard bars JB6 and JB7. Since the front-side base fabric 1 is joined to the back-side base fabric 2, the insertion yarns inserted by the guide bar GB5 are compressed. Thus, the line portion 212 does not bulge to become a concave portion.

To summarize the above description, on the front-side surface of the warp knitted fabric 210, the graphic portions 211 become bulging convex portions in an orange color, and the line portions 212 become non-bulging concave portions in white. In this manner, on the front-side surface of the warp knitted fabric 210, a jacquard pattern and irregularities conforming to the jacquard pattern are formed.

On the back-side surface of the warp knitted fabric 210, between the yarns fed from the front jacquard bars JB3 and JB4 and the yarns fed from the back jacquard bars JB6 and JB7, yarns which do not appear on the front-side surface mainly appear. Thus, on the back-side surface, a jacquard pattern in which the color is reversed with respect to the front-side surface is formed.

As described above, a jacquard pattern composed of the graphic portions 211 and the line portions 212 are formed on the front-side base fabric 1 and the back-side base fabric 2 of the warp knitted fabric 210, and further irregularities conforming to the jacquard pattern are formed. The line portions 212 correspond to a sewn-up portion in quilting.

(3) Effect

In the conventional general method of manufacturing a quilting, first, the front cloth and the back cloth are individually manufactured, and a core material made of cotton or the like is interposed between the front cloth and the back cloth, and finally sewed at a predetermined position.

However, according to the third embodiment, the front-side base fabric 1 as the front cloth and the back-side base fabric 2 as the back cloth are knitted at once, and simultaneously with the knitting, the insertion yarns are inserted from the guide bar GB5, as a core material. Further, at the same time, the front-side base fabric 1 is joined to the back-side base fabric 2. Thus, according to the third embodiment, the quilting may be manufactured with a dramatically high efficiency as compared to that in the conventional method.

Since it is possible to form holes in the quilting while performing knitting as described above, the quilting with holes may be manufactured with a dramatically high efficiency as compared to that in the conventional method.

4. Modified Example

The embodiments are exemplary only, and the scope of the present invention is not limited thereto. Various omissions, substitutions, and modifications may be made to the above described embodiments within the scope not deviating from the gist of the invention. Hereinafter, a modified example of the above described embodiments will be described.

First, the warp knitted fabric in each of the above described embodiments may be used for not only the shoe upper as exemplified above, or the like, but also various objects, e.g., clothing such as outerwear, interior goods, automotive materials such as interior materials, ceiling materials, or sheet materials of automobiles, medical supplies such as sanitary materials or medical clothing, bedding, chairs, a backrest part or a shoulder strap of a rucksack.

The above described knitting examples 1 to 3 are exemplary only, but various knitting methods other than the knitting examples 1 to 3 may be performed by the warp knitting machine in the above described embodiments.

In the above described embodiments, two colors of yarns are prepared, in which yarns of one color are fed to the front jacquard bars JB3 and JB4, and yarns of the other color are fed to the guide bars GB2, GB5, GB8, and GB9 and the back jacquard bars JB6 and JB7. However, the number of types of yarns to be used, or a method of feeding these yarns to jacquard bars and guide bars are not limited to those in the embodiments as described above.

For example, three colors of yarns may be prepared, in which yarns of one color are fed to the front jacquard bars JB3 and JB4, yarns of another color are fed to the back jacquard bars JB6 and JB7, and yarns of the other color are fed to the guide bars GB2, GB5, GB8, and GB9.

For example, multi-color yarns may be fed to the front jacquard bars JB3 and JB4 or the back jacquard bars JB6 and JB7 so that a color changes in the width direction of the jacquard bars. In this case, a jacquard pattern is formed in which a color changes in the width direction (the weft direction) of the warp knitted fabric.

In each of the above described embodiments, it is possible to insert a weft as an insertion yarn between the front-side base fabric 1 and the back-side base fabric 2 using the same structure as a weft insertion raschel machine. Accordingly, since the weft and the insertion yarn inserted by the guide bar GB5 are inserted between the front-side base fabric 1 and the back-side base fabric 2, the warp knitted fabric may bulge more largely. Meanwhile, when the weft is inserted between the front-side base fabric 1 and the back-side base fabric 2, all the adjacent wales are joined to each other. Thus, a hole may not be formed in the warp knitted fabric.

Two or more guide bars may be provided between a pair of jacquard bars at the front side and a pair of jacquard bars at the back side.

DESCRIPTION OF REFERENCE NUMERALS AND SIGNS

FN . . . front-side row of knitting needles, BN . . . back-side row of knitting needles, GB1, GB2, GB5, GB8, GB9 . . . guide bar, JB3, JB4, JB6, JB7 . . . jacquard bar, 1 . . . front-side base fabric, 2 . . . back-side base fabric,

3 . . . jacquard yarn, 4 . . . insertion yarn, 5 . . . joining position, 6 . . . non-joining position, 10 . . . warp knitted fabric, 11 . . . upper part, 12 . . . peripheral part, 20 . . . toe portion, 21 . . . front portion, 22 . . . instep portion, 23 . . . side portion, 24 . . . top portion, 25 . . . rear portion, 26 . . . heel portion, 30, 31, 32 . . . hole, 35 . . . quadrangular portion, 36 . . . first linear portion, 37 . . . second linear portion, 110 . . . warp knitted fabric, 111 . . . upper part, 112 . . . peripheral part, 120 . . . toe portion, 121 . . . front portion, 123 . . . side portion, 124 . . . top portion, 125 . . . rear portion, 126 . . . pattern portion, 127 . . . pattern portion, 130, 131 . . . hole, 210 . . . warp knitted fabric, 211 . . . graphic portion, 212 . . . line portion

The invention claimed is:

1. A method of manufacturing a warp knitted fabric, the method comprising:

knitting a front-side base fabric and a back-side base fabric using a double raschel machine including a pair of jacquard bars at a front side, and a pair of jacquard bars at a back side; and forming a jacquard pattern in the front-side base fabric and the back-side base fabric using jacquard yarns fed from the respective jacquard bars, by operating jacquard mechanisms of the pair of jacquard bars at the front side, and the pair of jacquard bars at the back side, respectively, wherein a joining position where the front-side base fabric is joined to the back-side base fabric by the jacquard yarns due to the operation of the jacquard mechanisms, and a non-joining position where the front-side base fabric is not joined to the back-side base fabric are provided, insertion yarns are inserted between the front-side base fabric and the back-side base fabric by at least one guide bar disposed between the pair of jacquard bars at the front side, and the pair of jacquard bars at the back side, and the insertion yarns are pressed by the front-side base fabric and the back-side base fabric at the joining position of the front-side base fabric and the back-side base fabric.

2. The method according to claim 1, wherein a chain stitch texture is formed in the front-side base fabric by a guide bar in front of the pair of jacquard bars at the front side, and a chain stitch texture is formed in the back-side base fabric by a guide bar in back of the pair of jacquard bars at the back side, a joining position where adjacent wales of the chain stitch texture are joined by the jacquard yarns and a non-joining position where the adjacent wales are not joined are formed in each of the front-side base fabric and the back-side base fabric, and the non-joining position of the adjacent wales of the chain stitch texture in the front-side base fabric is caused to match the non-joining position of the adjacent wales of the chain stitch texture in the back-side base fabric so as to form holes in the warp knitted fabric.

3. A warp knitted fabric having a jacquard pattern formed by jacquard yarns in a front-side base fabric and a back-side base fabric, wherein a joining position where the front-side base fabric is joined to the back-side base fabric by the jacquard yarns, and a non-joining position where the front-side base fabric is not joined to the back-side base fabric are provided, insertion yarns are inserted between the front-side base fabric and the back-side base fabric, and the insertion yarns are pressed by the front-side base fabric and the back-side base fabric at the joining position of the front-side base fabric and the back-side base fabric.

4. The warp knitted fabric according to claim 3, wherein at the non-joining position of the front-side base fabric and the back-side base fabric, a surface of the warp knitted fabric bulges toward at least one of a front side and a back side.

5. The warp knitted fabric according to claim 3, wherein a chain stitch texture is formed in each of the front-side base fabric and the back-side base fabric, a joining position where adjacent wales of the chain stitch texture are joined by the jacquard yarns and a non-joining position where the adjacent wales are not joined are formed, and the non-joining position of the adjacent wales in the front-side base fabric matches the non-joining position of the adjacent wales in the back-side base fabric in a front-back direction of the warp knitted fabric so as to form holes.

6. A shoe upper comprising the warp knitted fabric according to claim 3.

* * * * *